US007525032B2

(12) United States Patent
Mishima

(10) Patent No.: US 7,525,032 B2
(45) Date of Patent: Apr. 28, 2009

(54) PERCUSSION DETECTING APPARATUS AND ELECTRONIC PERCUSSION INSTRUMENT

(75) Inventor: Junichi Mishima, Iwata (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/396,208

(22) Filed: Mar. 30, 2006

(65) Prior Publication Data

US 2006/0219092 A1 Oct. 5, 2006

(30) Foreign Application Priority Data

Mar. 31, 2005 (JP) ..... 2005-101587
Sep. 26, 2005 (JP) ..... 2005-278317
Mar. 10, 2006 (JP) ..... 2006-066324

(51) Int. Cl.
*G10H 3/12* (2006.01)

(52) U.S. Cl. ..... 84/477 R; 84/723; 84/DIG. 12

(58) Field of Classification Search ..... 84/723, 84/724, DIG. 12, 477 R, 484
See application file for complete search history.

(56) References Cited

U.S. PATENT DOCUMENTS 4,279,188 A * 7/1981 Scott ..... 84/723
5,280,742 A * 1/1994 Vergara ..... 84/411 R
5,920,026 A * 7/1999 Yoshino et al. ..... 84/738
6,121,538 A 9/2000 Yoshino et al.
6,271,458 B1 8/2001 Yoshino et al.
2002/0112593 A1* 8/2002 Yanase ..... 84/411 P
2003/0209132 A1* 11/2003 Mishima ..... 84/730

* cited by examiner

*Primary Examiner*—Walter Benson
*Assistant Examiner*—Andrew R Millikin
(74) *Attorney, Agent, or Firm*—Morrison & Foerster LLP

(57) ABSTRACT

A percussion detecting apparatus and an electronic percussion instrument, which are capable of not only providing excellent percussion feeling, but also visually indicating a percussion pattern of a beat applied to a percussion surface, so as to serve for percussion practice as well as to increase interest in the percussion practice. A head of the percussion detecting apparatus is formed of an air-permeable material and has a light transmitting property. The head includes a percussion surface. A drum shell supports the head. A head sensor detects a beat applied to the percussion surface of the head and outputs a beat signal indicative of the sensed beat. A light radiating part is disposed on an opposite side from the percussion surface of the head so as to perform visual indication corresponding to a percussion pattern of the beat applied to the percussion surface, at least through the percussion surface, based on the beat signal output from the head sensor.

13 Claims, 16 Drawing Sheets

PERCUSSION DETECTING APPARATUS AND ELECTRONIC PERCUSSION INSTRUMENT

BACKGROUND OF THE INVENTION

1. Field of the Invention

The present invention relates to a percussion detecting apparatus that detects a beat signal for causing a drum device or the like to electronically generate a musical tone, according to a beat applied to a percussion surface, and an electronic percussion instrument.

2. Description of the Related Art

Conventionally, an electronic percussion instrument, such as an electronic drum, generally has a percussion surface part formed by a rubber pad (see e.g. Japanese Laid-Open Patent Publication (Kokai) No. 2000-47666). However, percussion feeling provided by the electronic percussion instrument is quite different from that provided by an acoustic percussion instrument.

On the other hand, there have also been proposed percussion detecting apparatuses having a percussion surface part formed of a mesh material (see Japanese Laid-Open Patent Publications (Kokai) No. H10-20854 and No. H10-198354). These percussion detecting apparatuses provide percussion feeling closer to that obtained from an acoustic percussion instrument than the apparatus having a percussion surface part formed by a rubber pad. Further, the percussion detecting apparatuses are capable of reducing the tone volume of a percussion tone directly generated therefrom.

There is also known a percussion instrument using a percussion detecting apparatus and provided with a percussion pattern indicating function for informing a player of a percussion pattern including a beat position on a pad and beat intensity. For example, in the above-mentioned percussion instrument disclosed in Japanese Laid-Open Patent Publication (Kokai) No. 2000-47666, a plurality of LEDs are arranged in a fixed part below the percussion surface part, and a light transmitter is disposed on the rubber pad at a location above the LEDs (see FIGS. 6 and 7 in Japanese Laid-Open Patent Publication (Kokai) No. 2000-47666). When the rubber pad is beaten, the distance between a portion of the light transmitter close to the beat position and an LED corresponding to the portion of the light transmitter changes, which causes a change in the amount of light that can be visually recognized via the light transmitter. Thus, a percussion pattern is indicated.

This enables the player to recognize beat positions on the pad and beat intensities, which serves for practice for percussion performance, thereby helping the player to make rapid progress in performance. In addition, since musical performance is visually recognized, interest in the musical performance is increased, which makes the performance enjoyable.

If this percussion pattern indicating function could be provided in the above-mentioned percussion detecting apparatus whose percussion surface part is formed of a mesh material, it would be ideal from the viewpoint of percussion feeling and percussion sound.

However, in the percussion detecting apparatuses disclosed in Japanese Laid-Open Patent Publications (Kokai) No. H10-20854 and No. H10-198354, since the percussion surface part is formed of a mesh material, it is not easy to attach the light transmitter to the percussion surface part. Even if the light transmitter could be successfully attached to the mesh material, durability of the portion of the percussion surface part where the light transmitter was attached would be low, and there is a fear that percussion feeling and sensing might be adversely affected by changes in the pattern of vibration of the mesh material during application of percussion. For this reason, in actuality, it has been impossible even to think of proving the percussion pattern indicating function in the percussion detecting apparatuses disclosed in Japanese Laid-Open Patent Publications (Kokai) No. H10-20854 and No. H10-198354 which have the percussion surface part formed of the mesh material.

Further, even the percussion detecting apparatuses having the percussion surface part formed of the mesh material do not provide percussion feeling which perfectly matches that obtained from an acoustic percussion instrument, but tend to provide percussion feeling with slightly excessive resilience. Therefore, when the player having practiced at one of the percussion detecting apparatuses plays the acoustic percussion instrument, he/she inevitably feels a sense of incongruity, and hence the percussion detecting apparatuses disclosed in Japanese Laid-Open Patent Publications (Kokai) No. H10-20854 and No. H10-198354 leave room for improvement. Furthermore, these percussion detecting apparatuses having the percussion surface part formed of the mesh material must be formed into a drum shape, and are low in the degree of freedom of design.

Further, it can be envisaged that pleasure will be further increased if the percussion pattern indicating function can be utilized for controlling musical tone generation in accordance with percussion.

SUMMARY OF THE INVENTION

It is a first object of the present invention to provide a percussion detecting apparatus and an electronic percussion instrument, which are capable of not only providing excellent percussion feeling, but also visually indicating a percussion pattern of a beat applied to a percussion surface, so as to serve for percussion practice as well as to increase interest in the percussion practice.

It is a second object of the present invention to provide a percussion detecting apparatus that is satisfactory in percussion feeding and small in percussion sound and that has a construction providing greater freedom of shape design.

To attain the first object, in a first aspect of the present invention, there is provided a percussion detecting apparatus comprising a percussion surface part formed of an air-permeable material and having a light transmitting property, the percussion surface part including a percussion surface, a support part that supports the percussion surface part, a detecting device that detects a beat applied to the percussion surface of the percussion surface part and outputs a beat signal indicative of the sensed beat, and a percussion pattern indicating device that is disposed on an opposite side from the percussion surface of the percussion surface part, for performing visual indication corresponding to a percussion pattern of the beat applied to the percussion surface, at least through the percussion surface, based on the beat signal output from the detecting device.

With the arrangement of the first aspect of the present invention, the percussion detecting apparatus is capable of not only providing excellent percussion feeling, but also visually indicating a percussion pattern of a beat applied to the percussion surface, so as to serve for percussion practice as well as to make the percussion practice enjoyable.

Preferably, the visual indication by the percussion pattern indicating device can be viewed both from a side toward the percussion surface and from the opposite side from the percussion surface.

Preferably, a plurality of the detecting devices are provided, the percussion pattern indicating device has a plurality of light emitting devices disposed at respective locations corresponding to the detecting devices, and each of the light emitting devices emits light in response to a beat signal output from at least a corresponding one of the detecting devices, whereby visual indication corresponding to the percussion pattern is performed.

Also preferably, the detecting device generates an electromotive force corresponding to the beat applied to the percussion surface of the percussion surface part, the percussion pattern indicating device has a light emitting device, and the light emitting device emits light based on the electromotive force generated by the detecting device, whereby visual indication corresponding to the percussion pattern is performed.

Preferably, the detecting device is disposed on the opposite side from the percussion surface in an outermost peripheral part of the percussion surface part.

Also preferably, the percussion pattern indicating device is disposed on the opposite side from the percussion surface in an outermost peripheral part of the percussion surface part.

To attain the first object, in a second aspect of the present invention, there is provided a percussion detecting apparatus comprising a percussion surface part formed of an air-permeable material and having a light transmitting property, the percussion surface part including a percussion surface, a support part that supports the percussion surface part, a detecting device that detects a beat applied to the percussion surface of the percussion surface part and outputs a beat signal indicative of the sensed beat, and a percussion pattern indicating device that performs visual indication corresponding to a percussion pattern of the beat applied to the percussion surface, at least through the percussion surface, based on the beat signal output from the detecting device, wherein the percussion pattern indicating device includes a light radiating part that radiates light, the light radiating part is disposed on an opposite side from the percussion surface of the percussion surface part such that the light radiating part is visible through the percussion surface part from a percussion surface side, the light radiating part being disposed at a location near or in contact with the percussion surface part when the percussion surface is not beaten, and a pattern of light radiation from the light radiation part changes in accordance with displacement of the percussion surface of the percussion surface part in a beat direction, the displacement being caused when the percussion surface is beaten, whereby visual indication corresponding to the percussion pattern is performed.

With the arrangement of the second aspect of the present invention, it is possible to provide the same advantageous effects as provided by the percussion detecting apparatus according to the first aspect of the present invention.

Preferably, the pattern of light radiation by the light radiating part changes according to a beat position on the percussion surface.

With the arrangement of this preferred embodiment, beat positions can be visually recognized, which further serves for percussion practice and increases interest in the practice.

To attain the first object, in a third aspect of the present invention, there is provided a percussion detecting apparatus comprising a percussion surface part formed of an air-permeable material and having a light transmitting property, the percussion surface part including a percussion surface, a support part that supports the percussion surface part, a detecting device that detects a beat applied to the percussion surface of the percussion surface part and outputs a beat signal indicative of the sensed beat, and a percussion pattern indicating device that performs visual indication corresponding to a percussion pattern of the beat applied to the percussion surface, at least through the percussion surface, based on the beat signal output from the detecting device, wherein the percussion pattern indicating device includes a light radiating part that is resilient and radiates light, the light radiating part is disposed on an opposite side from the percussion surface of the percussion surface part such that the light radiating part is visible through the percussion surface part from a side toward the percussion surface, and when the percussion surface of the percussion surface part is beaten, the light radiating part is pressed by the percussion surface part and is resiliently deformed, thereby applying a reaction force to the percussion surface part and changing a pattern of light radiation by the light radiating part, whereby visual indication corresponding to the percussion pattern is performed.

With the arrangement of the third aspect of the present invention, a percussion pattern is visually indicated by resilient deformation of the light radiating part, and at the same time excessive resilience of the percussion surface is suppressed by generation of a reaction force, which makes percussion feeling closer to that obtained from an acoustic percussion instrument. Therefore, it is possible not only to provide excellent percussion feeling by the simple construction, but also to visually indicate a percussion pattern of a beat applied to the percussion surface, so as to serve for percussion practice as well as to make the percussion practice enjoyable.

Preferably, the pattern of light radiation by the light radiating part changes according to a beat position on the percussion surface.

With the arrangement of this preferred embodiment, beat positions can be visually recognized, which further serves for percussion practice and increases interest in the practice.

Preferably, the light radiating part is formed into an annular shape, as viewed in plan view, with a central point of the percussion surface as a center.

With the arrangement of this preferred embodiment, since the light radiating part is formed into an annular shape, the effect of suppressing excessive resilience is uniformly provided at any beat position, and therefore irregular resilient action rarely occurs.

More preferably, the light radiating part has a plurality of light transmitting parts spaced from each other, and a plurality of fixedly disposed light emitting parts associated with the light transmitting parts, respectively, and when the percussion surface of the percussion surface part is beaten, the light radiating part is pressed by the percussion surface part and is resiliently deformed, thereby changing a distance between one of the light transmitting parts close to a beat position and an associated one of the light emitting parts, whereby the pattern of light radiation by the light radiating part is changed.

Alternatively, the light radiating part includes a hollow extending in a circumferential direction and a light emitting part contained in the hollow, at least an upper part of the light radiating part is formed of a material that transmits and scatters light, and when the percussion surface of the percussion surface part is beaten, the light radiating part is pressed by the percussion surface part and is resiliently deformed, thereby causing a larger amount of light to be emitted out from a resiliently deformed portion of the light radiating part than from the other portion of the light radiating part, whereby the pattern of light radiation by the light radiating part is changed.

With the arrangements of these preferred embodiments, beat positions can be visually recognized, which serves for percussion practice and increases interest in the practice.

Preferably, the percussion detecting apparatus comprises a signal output device that outputs an output signal that changes according to resilient deformation of the light radiating part, as the beat signal.

To attain the first object, in a fourth aspect of the present invention, there is provided a percussion detecting apparatus comprising a percussion surface part formed of an air-permeable material and having a light transmitting property, the percussion surface part including a percussion surface, a support part that supports the percussion surface part from inside, the support part having a holding part that is disposed to face a surface of the percussion surface part opposite from the percussion surface and is formed of a light-permeable material, a detecting device that detects a beat applied to the percussion surface of the percussion surface part and outputs a beat signal indicative of the sensed beat, and a percussion pattern indicating device having a light radiating part that radiates light, the percussion pattern indicating device performing visual indication corresponding to a percussion pattern of the beat applied to the percussion surface, through the holding part and the percussion surface, based on the beat signal output from the detecting device.

With the arrangement of the fourth aspect of the present invention, the percussion detecting apparatus is capable of providing excellent percussion feeling as well as visually indicating a percussion pattern of a beat applied to the percussion surface, to thereby serve for percussion practice and at the same time make the practice enjoyable.

Preferably, the percussion surface part has a projection formed on a central portion thereof such that the projection projects on a percussion surface side of the percussion surface part, and the percussion detecting apparatus comprises a beat detecting sensor provided in association with the projection so as to detect a beat applied to the percussion surface of the percussion surface part.

To attain the first object, in a fifth aspect of the present invention, there is provided a percussion detecting apparatus comprising a percussion surface part formed of an air-permeable material and having a light transmitting property, the percussion surface part including a percussion surface, a support part that supports the percussion surface part, a detecting device that detects a beat applied to the percussion surface of the percussion surface part and outputs a beat signal indicative of the sensed beat, a percussion pattern indicating device that performs visual indication corresponding to a percussion pattern of the beat applied to the percussion surface, at least through the percussion surface, based on the beat signal output from the detecting device, and a holding part that supports the percussion surface part, the holding part being resilient and disposed in an outer peripheral part of the support part between the percussion surface part and the support part.

With the arrangement of the fifth aspect of the present invention, it is possible to visually indicate a percussion pattern of a beat applied to the percussion surface. At the same time, it is possible to properly generate a reaction force against a beat applied to the percussion surface part, thereby properly suppressing excessive resilience of the percussion surface part.

Preferably, the detecting device also serves as the holding part.

Preferably, the percussion surface part covers not only an upper surface of the support part and the holding part but also an outer peripheral portion of the support part, and the percussion detecting apparatus comprises an adjusting device that adjusts detection sensitivity of the detecting device by adjusting tension of the percussion surface part applied in covering the holding part and the outer peripheral portion of the support part.

To attain the first object, in a sixth aspect of the present invention, there is provided an electronic percussion instrument comprising a percussion surface part formed of an air-permeable material and having a light transmitting property, the percussion surface part including a percussion surface, a support part that supports the percussion surface part, a plurality of detecting devices that detect a beat applied to the percussion surface of the percussion surface part and output beat signals indicative of the sensed beat, respectively, a percussion pattern indicating device that performs visual indication corresponding to a percussion pattern of the beat applied to the percussion surface, a musical tone generating device that generates a musical tone based on a beat signal output from at least one of the detecting devices, and a musical tone parameter control device that controls parameters for a musical tone to be generated by the musical tone generating device, based on at least one of a differential between a plurality of beat signals generated by corresponding ones of the detecting devices and a sum of the beat signals.

With the arrangement of the fourth aspect of the present invention, the percussion detecting apparatus is capable of providing excellent percussion feeling as well as visually indicating a percussion pattern of a beat applied to the percussion surface and generating a musical tone according to the percussion pattern, to thereby serve for percussion practice and make the practice enjoyable.

Preferably, the percussion pattern indicating device has a plurality of light emitting devices, and the light emitting devices emit light in response to the respective beat signals output from the detecting devices, to thereby perform visual indication corresponding to the percussion pattern.

To attain the first object, in a seventh aspect of the present invention, there is provided an electronic percussion instrument comprising a percussion surface part formed of an air-permeable material and having a light transmitting property, the percussion surface part including a percussion surface, a support part that supports the percussion surface part, an electromotive force generating device that generates an electromotive force corresponding to the beat applied to the percussion surface of the percussion surface part, a percussion pattern indicating device that has a plurality of light emitting devices caused to emit light by the electromotive force generated by the electromotive force generating device, and is operable when a beat is applied to the percussion surface of the percussion surface part, to perform visual indication corresponding to a percussion pattern of the beat, and a musical tone generating device that generates a musical tone based on the electromotive force generated by the electromotive force generating device.

To attain the first object, in an eighth aspect of the present invention, there is provided an electronic percussion instrument comprising a percussion surface part formed of an air-permeable material and having a light transmitting property, the percussion surface part including a percussion surface, a support part that supports the percussion surface part, a plurality of electromotive force generating devices that generate respective electromotive forces corresponding to a beat applied to the percussion surface of the percussion surface part, a percussion pattern indicating device that is operable when a beat is applied to the percussion surface of the percussion surface part, to perform visual indication corresponding to a percussion pattern of the beat, a musical tone generating device that generates a musical tone based on the electromotive forces generated by the electromotive force generating devices, and a musical tone parameter control device that controls parameters for the musical tone generated by the musical tone generating device, based on at least one of a differential between electromotive forces generated by corresponding ones of the electromotive force generating devices and a sum of the electromotive forces.

To attain the first object, in a ninth aspect of the present invention, there is provided an electronic percussion instrument comprising a percussion surface part formed of an air-permeable material and having a light transmitting property, the percussion surface part including a percussion surface, a support part that supports the percussion surface part, a detecting device that detects a beat applied to the percussion surface of the percussion surface part and outputs a beat signal indicative of the sensed beat, an electromotive force generating device that generates an electromotive force corresponding to the beat applied to the percussion surface of the percussion surface part, a musical tone generating device that generates a musical tone based on the beat signal output from the detecting device, and a percussion pattern indicating device that has a light emitting device that emits light based on the electromotive force generated by the electromotive force generating device, and is operable when a beat is applied to the percussion surface of the percussion surface part, to perform visual indication corresponding to a percussion pattern of the beat.

With the arrangements of the seventh to ninth aspects of the present invention, the percussion detecting apparatus is capable of providing excellent percussion feeling as well as visually indicating a percussion pattern of a beat applied to the percussion surface and generating a musical tone according to the percussion pattern, to thereby serve for percussion practice and make the practice enjoyable. Further, it is possible to dispense with power supply for light emission.

To attain the second object, according to a tenth aspect of the present invention, there is provided a percussion detecting apparatus comprising a percussion surface part formed of an air-permeable material and having a light transmitting property, a support part that supports the percussion surface part, a detecting device that detects a beat applied to a percussion face of the percussion surface part and outputs a beat signal, and a light emitting/irradiating device that emits/irradiates light in accordance with the beat signal output from the detecting device when the beat is applied to the percussion surface of the percussion surface part, wherein the percussion surface part is formed into a cymbal-shaped form in which a central portion, seen in plan, of the percussion surface part is projected.

According to the arrangement of the tenth embodiment, a novel luminous cymbal-shaped percussion constituted by air-permeable material (mesh) can be provided, in which mechanical noise can be reduced, an arbitrary electronic sound volume can be attained, and percussion can be visualized.

To attain the second object, according to an eleventh aspect of the present invention, there is provided a percussion detecting apparatus comprising a percussion surface part formed of a mesh material and having a light transmitting property, a support part that holds a periphery of the percussion surface part, and a detecting device that detects a beat applied to a percussion surface of the percussion surface part and outputs a percussion signal, wherein a central holding part is provided at a center portion of the support part so as to project upward, the center portion of the percussion surface part is supported by the central holding part, and a lower surface of the percussion surface part between the center portion of the percussion surface part and the periphery of the percussion surface part is pulled toward and fixed to the support part, so that the percussion surface part is formed into a cymbal-shaped form in which a central portion, seen in plan, of the percussion surface part is projected.

According to the arrangement of the eleventh embodiment, a novel luminous cymbal-shaped percussion constituted by a mesh material can be provided, in which mechanical noise can be reduced, an arbitrary electronic sound volume can be attained, and in addition more quite in sound than an acoustic cymbal can be attained. Since the holding member is included, a slower reboundness like a cymbal can be achieved by beating a different portion of the percussion surface part.

To attain the second object, according to a twelfth aspect of the present invention, there is provided a percussion detecting apparatus comprising a percussion surface part formed of a mesh material and having a light transmitting property, a support part supporting a periphery of the percussion surface part, a detecting device that detects a beat applied to a percussion surface of the percussion surface part and outputs a percussion signal, wherein a central holding part is provided at a center portion of the support part so as to project upward, the center portion of the percussion surface part is supported by the central holding part, and the percussion surface part is pulled downward and is fixed using an intervening member interposed between the support part and a lower surface of the percussion surface part located in vicinity of the central holding part, so that the percussion surface part is formed into a cymbal-shaped form in which a central portion, seen in plan, of the percussion surface part is projected.

According to the arrangement of the twelfth embodiment, a mesh type, cymbal-shaped electronic percussion can be provided without impairing mesh characteristics.

To attain the second object, according to a thirteenth aspect of the present invention, there is provided a percussion detecting apparatus comprising a percussion surface part formed of a mesh material and having a light transmitting property, a support part that holds a periphery of the percussion surface part, and a detecting device that detects a beat applied to a percussion surface of the percussion surface part and outputs a percussion signal, wherein the percussion surface part is formed into a cymbal-shaped form in which a central portion, seen in plan, of the percussion surface part is projected, the detecting device is disposed below the percussion surface part at a location between the central part and the periphery of the percussion surface part so as to face the support part, and the detecting device is a contactless percussion detecting sensor which is out of contact with the percussion surface part.

According to the arrangement of the thirteenth embodiment, the detecting device is installed contactlessly with the percussion surface part at an intermediate position between the central portion and the outer peripheral portion of the percussion surface part, and therefore a repulsive force from the percussion surface part generated when a beat is applied thereto is strengthened, making it possible for the user to play a one-hand flam.

To attain the second object, according to a fourteenth aspect of the present invention, there is provided a percussion detecting apparatus comprising a percussion surface part formed of a mesh material and having a light transmitting property, a support part that holds a periphery of the percussion surface part, and a detecting device that detects a beat applied to a percussion surface of the percussion surface part and outputs a percussion signal, wherein the percussion surface part is formed into a cymbal-shaped form in which a central portion, seen in plan, of the percussion surface part is projected, the detecting device is disposed below the percussion surface part at a location between the central part and the periphery of the percussion surface part so as to face the support part, and the detecting device includes a first contactless percussion detecting sensor which is out of contact with the percussion surface part and a second percussion detecting sensor disposed between the periphery of the percussion surface part and a portion of the support part opposed to the periphery of the percussion surface part.

According to the arrangement of the fourteenth aspect of the present invention, the detecting device is provided at an intermediate location between the central part and the periphery of the percussion surface part so as to be out of contact with the percussion surface part, and the user can play a one-hand flam. On the other hand, the user is permitted to conventionally play a flam by beating an outer periphery of the percussion surface part with sticks grasped by both hands.

To attain the second object, according to a fifteenth aspect of the present invention, there is provided a percussion detecting apparatus comprising a percussion surface part formed of an air-permeable material and having a light transmitting property, a support part that holds a periphery of the percussion surface part, a detecting device that detects a beat applied to a percussion surface of the percussion surface part and outputs a percussion signal, and a light emitting/irradiating device that emits/irradiates light in accordance with the beat signal output from the detecting device when the beat is applied to the percussion surface of the percussion surface part, wherein the percussion surface part is formed into a cymbal-shaped form in which a central portion, seen in plan, of the percussion surface part is projected, the detecting device is disposed below the percussion surface part at a location between the central part and the periphery of the percussion surface part so as to face the support part, the detecting device is a contactless percussion detecting sensor which is out of contact with the percussion surface part, and the light emitting/transmitting device is disposed at a same location as the detecting device as viewed in a direction obtained by connecting a center and the periphery of the percussion surface part.

According to the arrangement of the fifteenth embodiment, the quality of percussion in a flam play with one hand can be visually confirmed by both the player and person other than the player.

The above and other objects, features, and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

In the following, a first embodiment of the present invention will be described with reference to FIGS. 1 to 4C.

Figure 1:
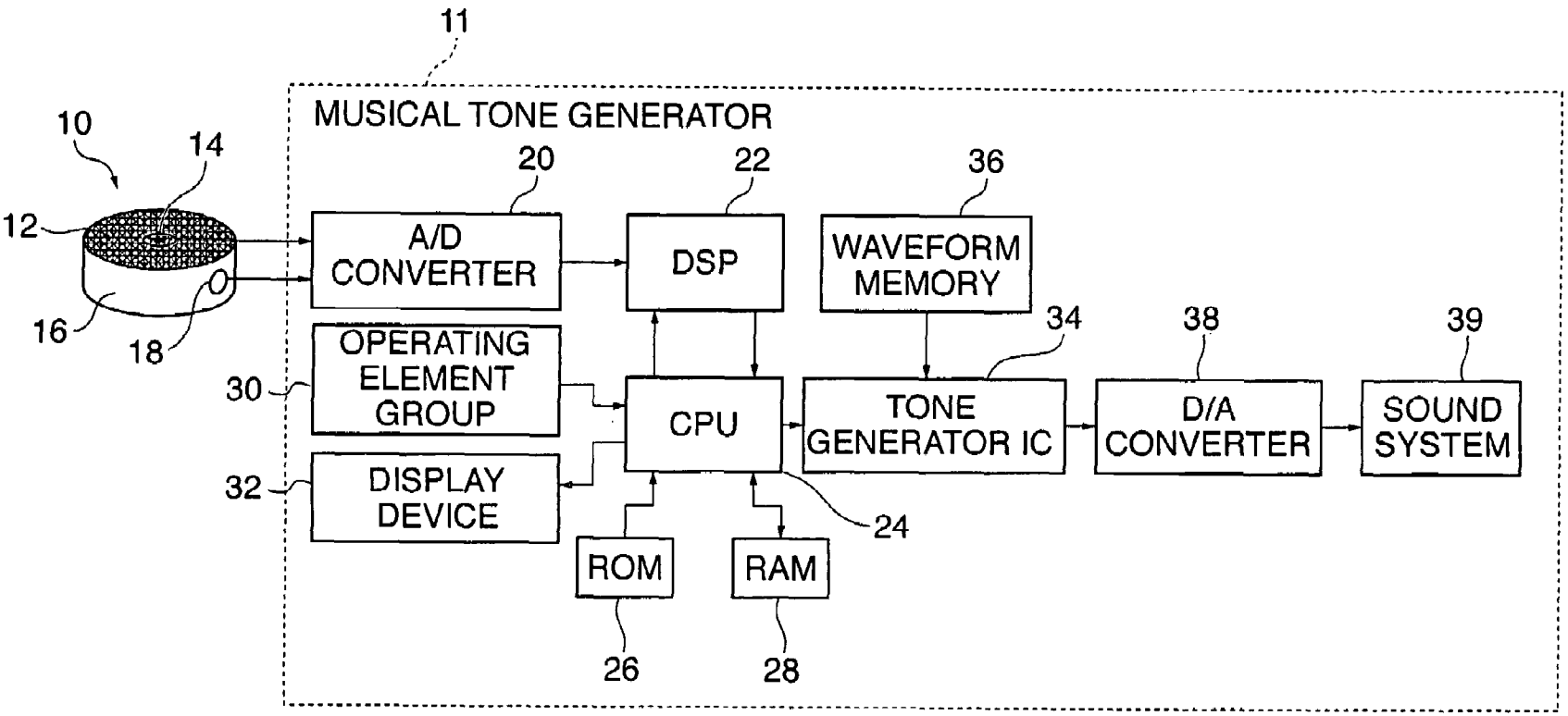
FIG. 1 is a block diagram of an electronic percussion instrument apparatus to which is applied a percussion detecting apparatus according to a first embodiment of the present invention.

FIG. 1 is a block diagram of an electronic percussion instrument apparatus to which is applied a percussion detecting apparatus according to the first embodiment. This electronic percussion instrument apparatus is formed by electrically connecting the percussion detecting apparatus 10 and a musical tone generator 11.

The percussion detecting apparatus 10 includes a head sensor 14 that detects beats applied to a head 12 having a percussion surface 12*a* formed of an air-permeable material (specifically, an air-permeable mesh material, for example), as described in detail hereinafter, and a rim shot sensor 18 that detects beats applied to a rim 16.

The musical tone generator 11 is comprised of a CPU 24 controlling the overall operation of the musical tone generator 11, and an operating element group 30, a display device 32, a read-only memory (ROM) 26, and a random access memory (RAM) 28, all connected to the CPU 24. Further, an A/D converter 20 is connected to the CPU 24 via a DSP 22, and a sound system 39 is connected to the same via a tone generator IC 34 and a digital-to-analog (D/A) converter 38. A waveform memory 36 is connected to the tone generator IC 34.

The A/D converter 20 subjects detection signals (beat signals) from the head sensor 14 and the rim shot sensor 18 to analog-to-digital (A/D) conversion in a time-sharing manner, and inputs the A/D converted signals to the DSP 22. The DSP 22 detects a beat applied to the head 12 and its intensity from the detection signal input from the head sensor 14 via the A/D converter 20, and a beat applied to the rim 16 and its intensity from the detection signal input from the rim shot sensor 18 via the A/D converter 20, and supplies these to the CPU 24. Further, a signal output from a photoreflector 46, referred to hereinafter, varying according to the amount of received light, and ON/OFF signals from first and second switches sw1 and sw2, referred to hereinafter, are input to the DSP 22 via the A/D converter 20.

The CPU 24 converts output from the DSP 22 into performance information, and supplies the performance information to the tone generator IC 34. At the same time, the CPU 24 detects operations of the operating element group 30 and carries out processing including control of the DSP 22. The ROM 26 stores programs and the like to be executed by the CPU 24. The RAM 28 not only stores various kinds of data, but also provides a work area required for execution of the programs by the CPU 24. The operating element group 30 includes operating elements, not shown, for use in operation mode setting, tone color selection, level setting, and so forth. The display device 32 displays various kinds of information. The waveform memory 36 stores sampling waveform data for forming musical tone signals. The tone generator IC 34 reads out sampling waveform data from the waveform memory 36 according to the performance information from the CPU 24, and forms a digital musical tone signal to output the digital musical tone signal to the D/A converter 38. The D/A converter 38 converts the digital musical tone signal supplied from the tone generator IC 34 into an analog musical tone signal, and the sound system 39 comprised of an amplifier and a speaker converts this analog musical tone signal into sound.

Figure 2:
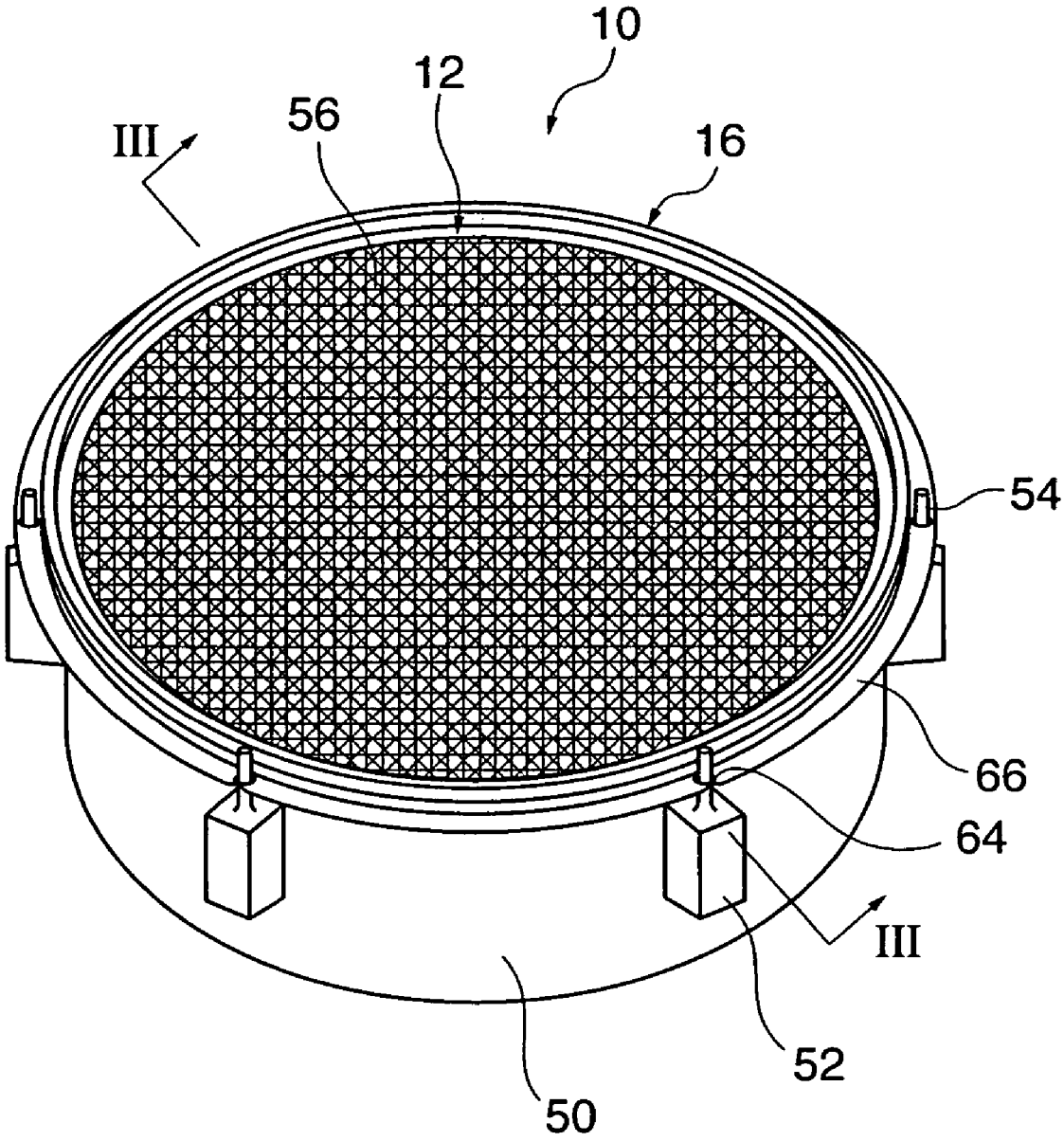
FIG. 2 is a perspective view of the percussion detecting apparatus.
Figure 3:
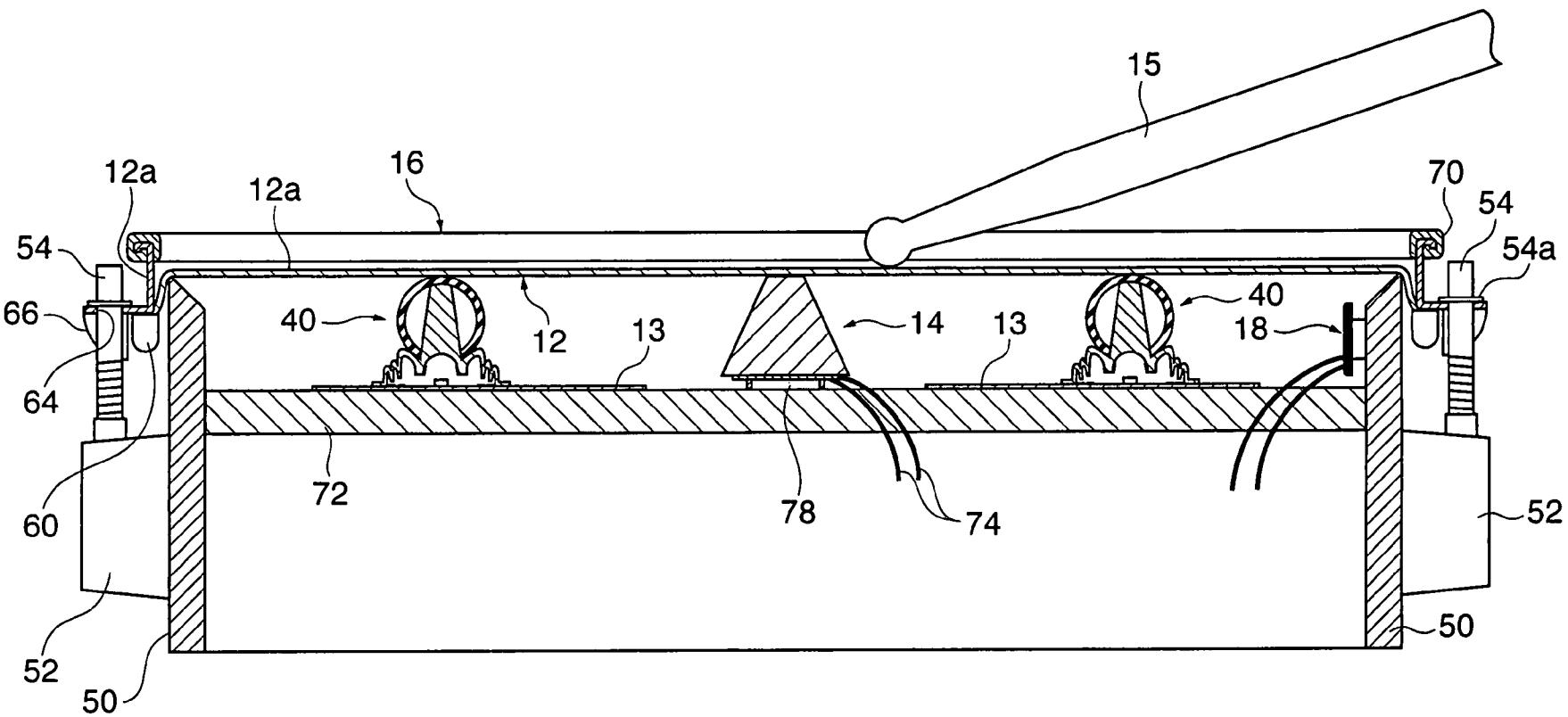
FIG. 3 is a cross-sectional view taken on line III-III of FIG. 2.

FIG. 2 is a perspective view of the percussion detecting apparatus 10. FIG. 3 is a cross-sectional view taken on line III-III in FIG. 2. The percussion detecting apparatus 10 has a hollow cylindrical drum shell 50, and on an outer periphery of the hollow cylindrical drum shell 50, a plurality of engaging parts each formed with a screw hole, not shown, are arranged at predetermined spaced intervals such that they project radially from the drum shell 50. Screwed in the screw hole of each of the engaging parts is an engaging pin 54 formed with a thread for screwing into the screw hole, and the outer peripheral part of the head 12 and the rim 16 are mounted on the drum shell 50 via the engaging pins 54. The engaging pin 54 is formed with an engaging protrusion 54*a* for retaining the rim 16.

The head 12 has a translucent percussion surface part formed of an air-permeable material. As the air-permeable material, there is employed a mesh material 56 formed by laminating two plain-woven circular meshes (not shown on an individual basis) having longitudinal and lateral fibers orthogonal to each other, such that weaving directions of the two meshes cross each other obliquely (at approximately 45 degrees). The head 12 is formed by bonding the mesh material 56 to an annular frame 60 (see FIG. 3). The head 12 is not necessarily required to be formed by the two meshes laminated one upon the other, but may have a percussion surface part formed e.g. of an air-permeable material which is a transparent sheet formed with a large number of holes. Along the outer periphery of the rim 16, there is formed a flange part 66 formed therethrough with holes 64 through which the respective engaging pins 54 can be inserted, and a rim percussion part 68 extends upward from an inner periphery of the flange part 66. The rim percussion part 68 has an upper part thereof covered with a cover member 70 formed of a resilient material.

In mounting the head 12 and the rim 16 on the drum shell 50, first, the head 12 is placed on the drum shell 50, and then the rim 16 is placed on the head 12 from above, whereafter alignment is carried out for communication between the holes 64 of the rim 16 and the corresponding screw holes in the respective engaging parts 52 of the drum shell 50. Then, each of the engaging pins 54 is screwed into the corresponding one of the screw holes in the respective engaging parts 52 via the corresponding hole 64 of the rim 16, whereby the head 12 and the rim 16 are mounted on the drum shell 50 in a manner pressed against the drum shell 50 by the engaging protrusions 54*a* of the respective engaging pins 54.

As the engaging pins 54 are screwed deeper into the respective engaging parts 52, the frame 60 of the head 12 is more intensely pressed downward by the engaging protrusions 54*a* via the flange part 66 of the rim 16. Thus, the two meshes of the head 12 are stretched on the drum shell 50 with a predetermined tension. Therefore, the tension of the meshes can be adjusted as desired by adjusting the screwing depth of the engaging pins 54.

A head sensor support member 72 formed into a circular plate shape is horizontally disposed within the drum shell 50. The head sensor 14 and an annular light radiating part 40 are disposed on the head sensor support member 72.

Figure 4A:
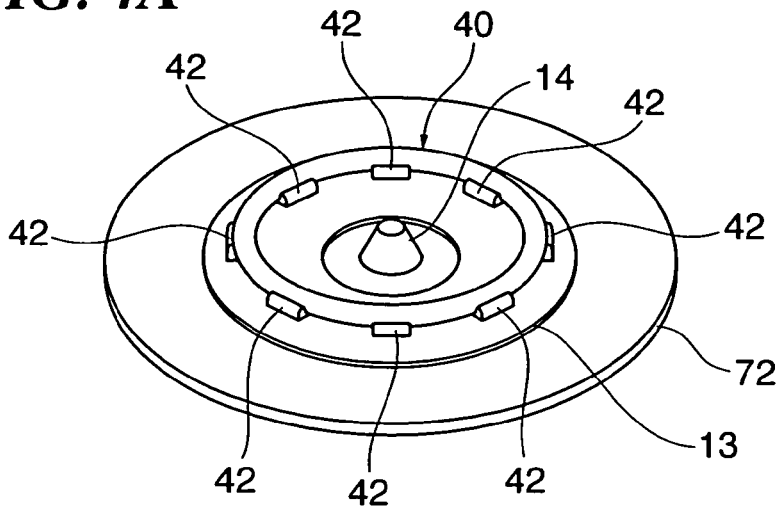
FIG. 4A is a perspective view of a head sensor support member and components arranged thereon.
Figure 4B:
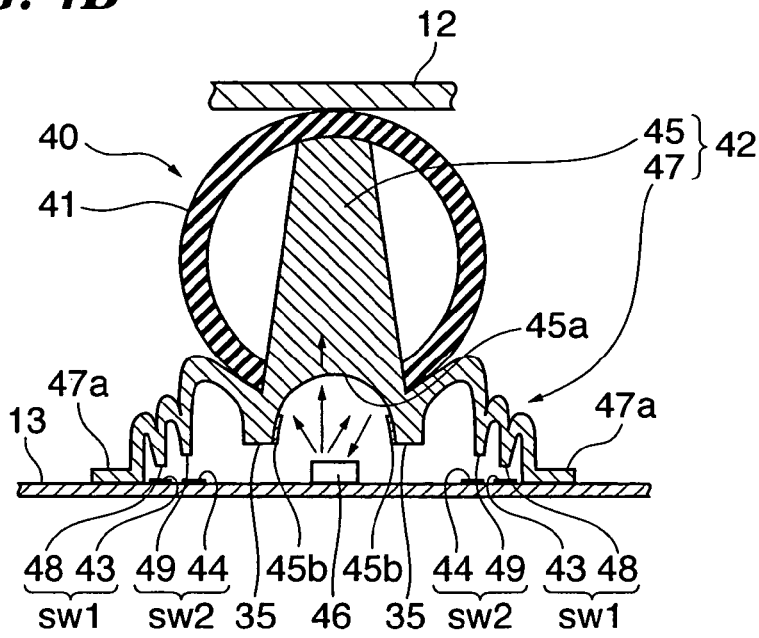
FIG. 4B is a fragmentary cross-sectional view of a light radiating part.
Figure 4C:
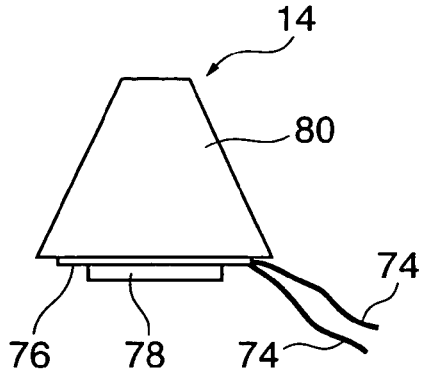
FIG. 4C is a side view of the head sensor.

FIG. 4A is a perspective view of the head sensor support member 72 and components arranged thereon. FIG. 4B is a fragmentary cross-sectional view of the light radiating part 40. FIG. 4C is a side view of the head sensor 14.

As shown in FIG. 4C, the head sensor 14 includes a disk-shaped piezoelectric element 76 provided with signal lines 74, and is fixedly affixed to a central location on the upper surface of the head sensor support member 72 by a double-faced tape 78 affixed to the lower surface of the piezoelectric element 76 (see FIGS. 3 and 4A). Further, a cushion member 80 formed of a resilient material, such as rubber or sponge, and having a truncated conical shape is fixedly affixed to the upper surface of the piezoelectric element 76. The cushion member 80 has its diameter thereof progressively reduced toward the upper end thereof. When no beat is applied, the upper end of the cushion member 80 having the reduced diameter is in contact with the lower surface of the center of the head 12.

As shown in FIG. 3, the rim shot sensor 18 is affixed to the inner upper part of the drum shell 50. The rim shot sensor 18 is identical in construction to the head sensor 14 with the cushion member 80 removed therefrom.

Further, as shown in FIGS. 3 and 4A, on the upper surface of the head sensor support member 72, there is disposed an annular base plate 13, on which the light radiating part 40 is disposed such that it has an annular shape in plan view. As shown in FIG. 4B, the light radiating part 40 is comprised of a plurality of movable light transmitting parts 42 each provided as a movable part with a light transmitter, a single tube body 41 generally in the form of a tube, a plurality of photoreflectors 46 each provided as a light emitting part, and a plurality of fixed contacts 43 and 44. The photoreflectors 46 are circumferentially arranged at equal space intervals e.g. at eight locations on the base plate 13. Each of the movable light transmitting parts 42 is disposed on the base plate 13 in a manner facing a corresponding one of the photoreflectors 46 from above. The movable light transmitting part 42 is comprised of a column body 45 formed into a circular shape in cross section with its diameter progressively reduced toward the upper end thereof, and provided as a light transmitter or a translucent part, and a corrugated skirt part 47 integrally formed with the column body 45.

The tube body 41 is formed as a unitary member having an annular shape, and has a lower part thereof slightly open downward over the entire circumference thereof. Each of portions of the tube body 41 corresponding to the respective movable light transmitting parts 42 has the open lower part thereof fixed, e.g. by bonding, to a portion of the associated movable light transmitting part 42 in the vicinity of the connecting part between the column body 45 and the skirt part 47. Further, the upper end of the column body 45 is fixed e.g. by bonding to the inner ceiling surface of the tube body 41. Thus, the tube body 41 is, as it were, transfixed with the column bodies 45 from below. It should be noted that although portions of the tube body 41 which are not associated with the movable light transmitting parts 42 have openings left open downward, these openings may be closed or the tube body 41 may be formed such that it has no such openings.

The tube body 41 is formed of a transparent or translucent and resilient material, such as vinyl chloride. The movable light transmitting part 42 is formed of a transparent and resilient material, such as rubber. When no beat is applied, the upper end of the tube body 41 is in light contact with the lower surface of the head 12. It should be noted that the tube body 41 may be disposed at a location close to the lower surface of the head 12 without contact therewith.

All the movable light transmitting parts 42 have the same construction. Each movable light transmitting part 42 has a contact part 35 formed into an annular shape, as viewed from the bottom, in a manner projecting downward. The inner surface of the contact part 35 forms a dome-shaped recessed surface 45*a*. A hollow is formed between the recessed surface 45*a* and the associated photoreflector 46. The recessed surface 45*a* has a lower half part thereof coated with a white coating material 45*b*. Further, the movable light transmitting part 42 has a flange part 47*a* extending outward from the lower part of the skirt part 47, and the flange part 47*a* is fixed to the upper surface of the base plate 13, whereby the movable light transmitting part 42 is disposed such that the recessed surface 45*a* covers the photoreflector 46 and the skirt part 47 covers the fixed contacts 43 and 44.

The skirt part 47 has a lower part thereof formed with movable contacts 48 and 49 opposed to the fixed contacts 43 and 44, respectively. The movable contact 48 and the fixed contact 43 form the first switch sw1, and the movable contact 49 and the fixed contact 44 form the second switch sw2. Each photoreflector 46 is formed by a pair of a light emitting element (LED or the like), not shown, and a light receiving element (phototransistor or the like), not shown. The light emitting element is driven by a drive circuit, not shown, to constantly emit light at a constant luminance level. The light receiving element outputs a signal corresponding to a light receiving level.

As described in detail hereinafter, when the head 12 is beaten e.g. with a stick 15 (see FIG. 3), a movable light transmitting part 42 closest to the beat position is mainly pressed by the head 12 via the tube body 41. At this time, the skirt part 47 is resiliently deformed, whereby the column body 45 is moved in a beat direction (vertical direction), and the distance between the recessed surface 45*a* and the photoreflector 46 changes in accordance with the vertical motion of the column body 45. This change in the distance is shown as a change in emission intensity of the column body 45 as described hereinafter. Part of light emitted from the light emitting element of the photoreflector 46 enters the column body 45 from the recessed surface 45*a* and passes through the upper end surface of the column body 45 and an upper part of the tube body 41, followed by being emitted outside. In this case, since the head 12 is formed of the mesh material 56, the emitted light can be viewed by the player through the mesh.

The mesh material 56 produces a mesh which is air permeable. The mesh material 56 has a light transmitting property, even if it is a black opaque material. Thus, the "percussion surface part formed of an air-permeable material and having a light transmitting property" includes a light-transmissive percussion surface part that is formed of a light-opaque material and having air permeability.

Further, when the column body 45 moves downward and brings the contact part 35 also functioning as an excessive press-preventing stopper into contact with the base plate 13, the motion of the column body 45 is limited. At this time, the photoreflector 46 is completely enclosed by the recessed surface 45*a*, and at the same time the white coating material 45*b* provides a reflection effect, so that the light emitted from the photoreflector 46 is collected without being scattered in all directions, to effectively enter the column body 45 from the recessed surface 45*a*. As a consequence, the luminance of the upper end surface of the column body 45 closest to the beat position becomes higher than that of any other column body 45. Further, the luminance changes according to the intensity (depth) of a beat such that as the depth is larger, the luminance becomes higher. Therefore, a percussion pattern indicative of a beat position and a beat intensity is visually indicated. Since the tube body 41 has an annular shape, a beat position is recognized by determining which of the movable light transmitting parts 42 is most intensely illuminated, or more specifically, by an angular position about the center point of the head 12.

Part of the light emitted from the light emitting element of the photoreflector 46 is reflected on the recessed surface 45*a* and is received by the light receiving element. As the column body 45 moves downward, the amount of light received by the light receiving element increases due to the reflection effect and light collection effect of the white coating material 45*b*. It should be noted that switching may be performed by the first switch sw1 and the second switch sw2, and a simple high-luminance LED may be provided in place of the photoreflector 46.

When the skirt part 47 is resiliently deformed to move the column body 45 downward, first, the movable contact 48 comes into contact with the fixed contact 43 to turn on the first switch sw1, and then the movable contact 49 comes into contact with the fixed contact 44 to turn on the second switch sw2. Therefore, when a beat with medium intensity is applied, only the first switch sw1 is turned on, and when a more intense beat is applied, the first and second switches sw1 and sw2 are sequentially turned on with a short time lag.

When a beat is applied to the head 12 with the stick 15, the head sensor 14 detects the beat, whereas when a beat is applied to the rim 16 with the stick 15, the rim shot sensor 18 detects the beat. The DSP 22 (see FIG. 1) detects a beat and its intensity from a detection signal input from the head sensor 14 or the rim shot sensor 18, e.g. by detecting the peak value of the input signal. The processing is performed by a known method, and hence description thereof is omitted.

Since the head 12 formed of the mesh material 56 is resilient, percussion feeling obtained when the head 12 is beaten with the stick 15 is better than that provided by a conventional electronic drum apparatus having a percussion surface part formed by a rubber pad, and percussion sound directly generated by the head 12 is smaller. Further, since the head 12 is formed, as described hereinabove, by laminating the two plain-woven circular meshes having longitudinal and lateral fibers orthogonal to each other such that weaving directions of the two meshes cross each other obliquely, uniform tension is applied to the entire mesh material 56, and therefore variation in percussion feeling due to positional differences among beats is rarely caused.

However, percussion feeling provided by the head 12 alone tends to be too much resilient compared with that provided by an acoustic percussion instrument. To solve this problem, in the present embodiment, the movable light transmitting parts 42 are used not only for indicating a percussion pattern, but also as reaction force-generating (vibration-preventing) means for generating reaction force against beats, so as to suppress excessive resilience of the head 12.

More specifically, the tube body 41 is in contact with the head 12 over the entire length thereof, so that when the head is beaten, the tube body 41 is pressed by the head 12. Particularly when a beat position is close to a portion of the head 12 immediately above a certain movable light transmitting part 42, the skirt part 47 of the movable light transmitting part 42 corresponding to the beat position is resiliently deformed, and after the contact part 35 having been brought into contact with the base plate 13, the column body 45 also resiliently contracts. Further, a portion of the tube body 41 close to the beat position is also bent in accordance with the motion and contraction of the column body 45.

On the other hand, when a beat position is away from any movable light transmitting part 42, in a movable light transmitting part 42 closer to the beat position, not only do occur resilient deformation of the skirt part 47 and contraction of the column body 45, but also a portion of the tube body 41 close to the beat position is bent. As described above, irrespective of whether a beat position is close to a movable light transmitting part 42 or away from any movable light transmitting part 42, a beat force is absorbed by bending of the skirt part 47, contraction of the column body 45, and bending of the tube body 41, and these actions generate proper reaction force against the beat to thereby perform the vibration-preventing function.

The CPU 24 controls the tone generator IC 34, the D/A converter 38, the sound system 39, and the waveform memory 36 all shown in FIG. 1, based on the detection signals from the head sensor 14 and the rim shot sensor 18 (hereinafter referred to as "the head beat signal" and "the rim beat signal", respectively), the ON/OFF signals from the first and second switches sw1 and sw2, and a signal indicative of a sensed amount of light received by the light receiving element of the photoreflector 46 (hereinafter referred to as "the light receiving amount signal"), so as to generate musical tones.

More specifically, first, a percussion instrument tone is sounded in response to the head beat signal or the rim beat signal, in a tone color set for percussion applied to the head or the rim and at a volume corresponding to a beat intensity indicated by the head beat signal or the rim beat signal. Particularly in the case of tone sounding in response to the head beat signal, a musical tone parameter changes according to the light receiving amount signal, which causes a change in sounding tone color, for example. Further, in some case, the first and second switches sw1 and sw2 close to the beat position are turned on. In such a case, second and third percussion instrument tones are sounded in response to the ON/OFF signals from the first and second switches sw1 and sw2, separately from the percussion instrument tone sounded in response to the head beat signal, in a manner superimposed thereon.

In this case, the second and third percussion instrument tones may be sounded as fixed effect sound, or as tones different in pitch (tones slightly different or different by 3 or 5 degrees) from the main percussion instrument tone sounded based on the head beat signal. Alternatively, they may be sounded as tones slightly different in tone color from the main percussion instrument tone. The main percussion instrument tone is followed by the second percussion instrument tone and the third percussion instrument tone sounded with a slight time lag, so that deep sound can be easily generated by a single beat.

The musical tone parameter to be changed according to the light receiving amount signal is not limited to tone color, but it may be localization (PAN). In this case, localization is two-dimensionally (longitudinally and laterally) changed according to light receiving amount signals output from the eight movable light transmitting parts 42, respectively. For example, if the light receiving amount signal from a movable light transmitting part 42 on the right side, as viewed from an operator, is the largest, localization is shifted rightward. However, this is not limitative, but localization may be three-dimensionally defined. In this case, for example, if the center of the head 12 is beaten and light receiving amount signals output from all the movable light transmitting parts 42 are approximately equal to each other, localization is set to the vertically upward direction.

The combination of signals and processes responsive thereto, or more specifically, how to combine sounding of the main percussion instrument tone, changing of a musical tone parameter, and sounding of the second and third percussion instrument tones is not limited to the above described example. For example, the ON/OFF signal may be used in place of the light receiving amount signal to change the musical tone parameter.

Further, not the head beat signal but the light receiving amount signal or the ON/OFF signal may be used for sounding the main percussion instrument tone. In this case, the head sensor 14 can be dispensed with if it is not required to change a musical tone parameter or sound the second and third percussion instrument tones.

Furthermore, the light receiving amount signal may be used for sounding the main percussion instrument tone, and the ON/OFF signal may be used for changing the musical tone parameter or sounding the second and third percussion instrument tones. Alternatively, the ON/OFF signal may be used for sounding the main percussion instrument tone, and the light receiving amount signal for changing the musical tone parameter. Therefore, in order to generate the main percussion instrument tone, it is only required to use at least one of the head sensor 14, the photoreflector 46, and the first and second switches sw1 and sw2, or to provide at least one of them.

According to the present embodiment, when the percussion surface 12*a* as the upper surface of the head 12 is beaten, resulting deformation of the percussion surface 12*a* in the beat direction causes a change in the amount of light emitted from the upper surface of the tube body 41 mainly through the column body 45 of a movable light transmitting part 42 of the light radiating part 40 closest to a beat position. Thus, the amount of emitted light changes in accordance with change in the intensity of percussion applied to the percussion surface 12*a*, and the change can be viewed through the mesh of the percussion surface 12*a*. Further, since the movable light transmitting parts 42 are provided at a plurality of locations, respectively, and the amounts of light emitted from the respective movable light transmitting parts 42 vary according to the distances between the movable light transmitting parts 42 and a beat position, the pattern of light radiation by the light radiating part 40 varies with the beat position. Thus, the percussion pattern (beat intensity and position) on the percussion surface 12*a* is visually indicated by the light radiating part 40, which serves for percussion practice, thereby helping the player to make rapid progress in performance. In addition, since musical performance is visually recognized, interest in the musical performance is increased, which makes the performance enjoyable.

Further, while the head 12 formed of the mesh material 56 is more excellent in resilience than a rubber pad, the light radiating part 40 pressed by the head 12 generates an adequate reaction force, thereby suppressing excessive resilience of the head 12, so that the interaction between the head 12 and the light radiating part 40 makes it possible to provide good percussion feeling close to that provided by an acoustic percussion instrument. Moreover, since the light radiating part 40 is formed into an annular shape with the movable light transmitting parts 42 arranged at a number of locations spaced from each other, the effect of suppressing excessive resilience can be uniformly provided in response to a beat at any beat position to thereby reduce variation in resilience.

Furthermore, the light radiating part 40 is not only provided with the function of visually indicating a percussion pattern, but also configured to serve as the means for generating reaction force against a beat applied to the head 12 and the vibration-preventing means for preventing the percussion surface part from being excessively resilient, which contributes to simplification of the construction of the apparatus.

It should be noted that if the head sensor 14 is dispensed with, and the main percussion instrument tones are sounded using the photoreflectors 46 or the first and second switches sw1 and sw2, beat signals are detected according to resilient deformation of the light radiating part 40. In this case, the light radiating part 40 is not only provided with the function of visually indicating percussion patterns and the function of generating reaction force against beats applied to the head 12, but also the function of detecting beat signals, which contributes to further simplification of the construction of the apparatus. From this viewpoint, the means for detecting beat signals according to resilient deformation of the light radiating part 40 is not limited to the photoreflectors 46 or the first and second switches sw1 and sw2, but a piezoelectric sensor or the like may be employed.

Next a description will be given of a second embodiment of the present invention.

The second embodiment is distinguished from the first embodiment in that a light radiating part 140 is provided in place of the light radiating part 40 in the first embodiment. The other components are identical to the corresponding ones in the first embodiment.

Figure 5A:
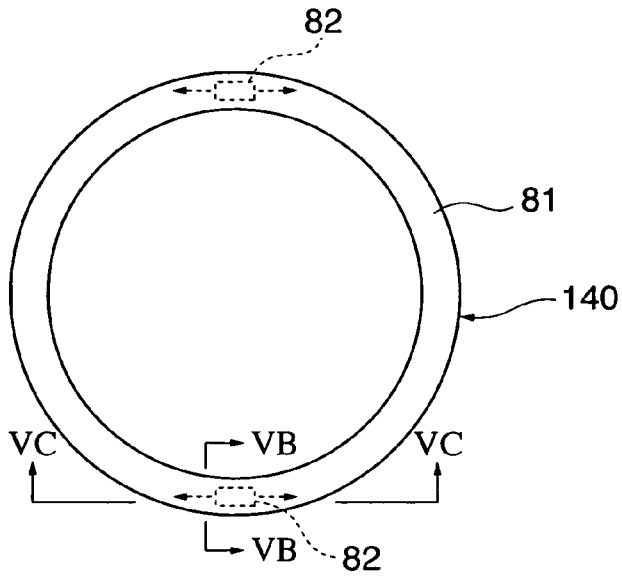
FIG. 5A is a plan view of a light radiating part of a percussion detecting apparatus according to a second embodiment of the present invention.
Figure 5B:
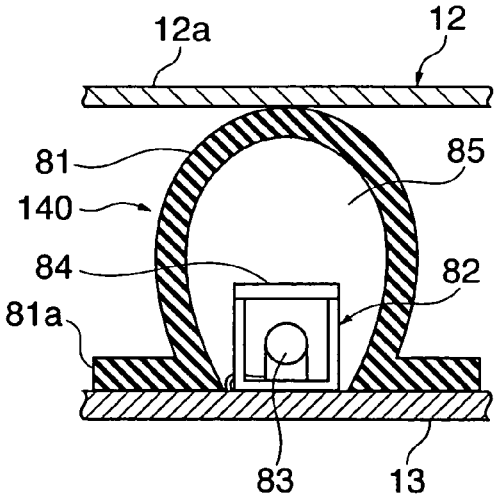
FIG. 5B is a cross-sectional view taken on line VB-VB of FIG. 5A.

FIG. 5A is a plan view of the light radiating part 140 of a percussion detecting apparatus according to the second embodiment. FIG. 5B is a cross-sectional view taken on line VB-VB in FIG. 5A, and FIG. 5C a cross-sectional view taken on line VC-VC in FIG. 5A.

The light radiating part 140 of the percussion detecting apparatus according to the present embodiment is comprised of a tube body 81, and two light emitting units 82. Similarly to the light radiating part 40, the light radiating part 140 is formed into an annular shape as viewed in plan view, and has an Ω-shaped cross section formed by the tube body 81 and flange parts 81*a*, as shown in FIG. 5B. The flange parts 81*a* are fixed to an upper surface of the base plate 13. The upper part of the tube body 81 is in contact with or in close proximity to the head 12. The tube body 81 is not in the form of a complete tube, but open downward such that a hollow 85 is formed by the inner surface of the peripheral wall of the tube body 81 and the upper surface of the base plate 13.

The tube body 81 is formed of a resilient material similarly to the tube body 41. However, the tube body 81 is larger in thickness, and hence harder to bend than the tube body 41. Almost all of reaction force generated by the light radiating part 140 when the percussion surface 12*a* of the head 12 is beaten comes from resilient deformation of the tube body 81. Further, the material forming the tube body 81 is mixed with white resin particles (size of several tens of μm) with a light scattering property, so as to scatter light transmitted through the tube body 81, in a wide angle. It suffices that this property is imparted to at least the upper half part of the tube body 81, and hence, for example, the tube body 81 may be formed e.g. by two-color molding of a transparent resin and a resin mixed with the above-mentioned white resin particles such that only the upper half part contains the white resin particles.

Figure 5C:
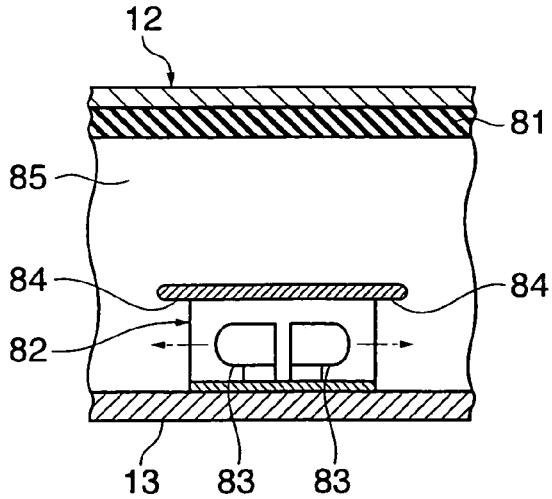
FIG. 5C is a cross-sectional view taken on line VC-VC of FIG. 5A.

The two light emitting units 82 are disposed on the base plate 13 at diametrically opposite locations in the annular tube body 81 such that they are most spaced from each other. The two light emitting units 82 have the same construction. As shown in FIG. 5C, each of the light emitting units 82 has two light emitting parts (LEDs) 83 arranged in back-to-back relation in the circumferential direction of the tube body 81, and these light emitting parts 83 emit light into the hollow part 85. It should be noted that the light emitting unit 82 has an upper end part thereof formed with a flange part 84 extending outward of the light emitting parts 83 in the circumferential direction of the tube body 81. The flange part 84 prevents light emitted from the light emitting parts 83 from being directly viewed from above.

Figure 6B:
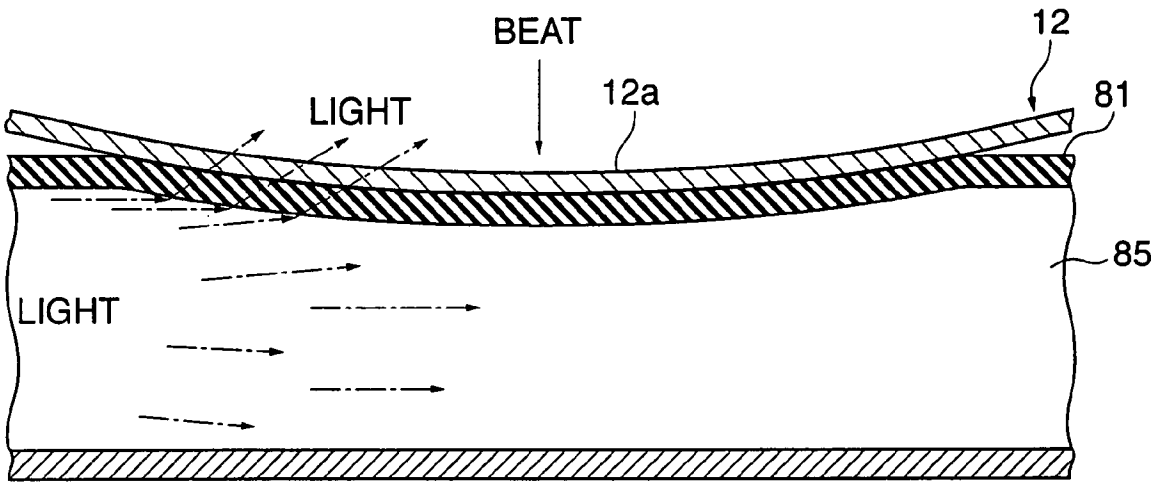
FIG. 6B is a schematic view corresponding to FIG. 5C but showing the light radiating part at a time when the head is beaten.
Figure 6A:
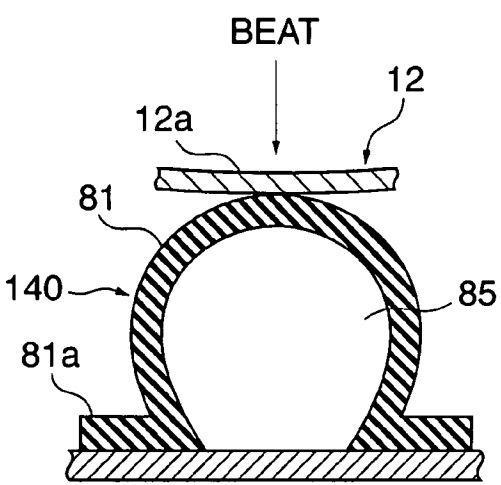
FIG. 6A is a schematic view corresponding to FIG. 5B but showing the light radiating part at a time when a head is beaten.

FIGS. 6A and 6B are schematic views corresponding to FIGS. 5B and 5C, respectively, and showing the light radiating part 140 at a time when the head 12 is beaten.

Much of the light emitted from the light emitting parts 83 passes relatively straight through the hollow part 85 of the tube body 81. At this time, part of the light is absorbed in the inner wall surface of the hollow part 85 or reflected on the same. Therefore, the inside of the hollow part 85 is wholly illuminated. Part of the light having passed through the tube body 81 is scattered. Therefore, when no percussion is being applied, the entire tube body 81 gleams. At this time, the brightness of the tube body 81 is low, so that the light from the tube body 81 can hardly be visually recognized through the mesh of the head 12.

On the other hand, when the percussion surface 12*a* of the head 12 is beaten, the tube body 81 is bent, as shown in FIGS. 6A and 6B, to generate an adequate reaction force, whereby excessive resilience of the head 12 is suppressed. Further, although much of light emitted from the light emitting parts 83 passes straight through the hollow part 85 as shown by arrows in FIG. 6B, since a portion of the tube body 81 close to the beat position is bent below, a larger amount of the emitted light is emitted to the outside through the bent portion than through any other portion. As a consequence, the light is visually recognized as if emitted only from the portion close to the beat position. Thus, the intensity and position of a beat can be recognized by light.

According to the present embodiment, it is possible to provide the same advantageous effects as provided by the first embodiment.

It should be noted that three or more light emitting units 82 may be provided. However, it is only required that at least one light emitting unit 82 is provided, and the light emitting unit 82 may also include a single light emitting part 83.

Next, a description will be given of a third embodiment of the present invention.

The third embodiment is distinguished from the first embodiment in that a means for generating a reaction force against a beat applied to the head 12 is provided in the vicinity of the outer periphery of the head 12 separately from the light radiating part. Further, the light radiating part 40 is formed to be softer than in the first embodiment so as to reduce a reaction force generated by the light radiating part 40 itself. The other components are identical to the corresponding ones in the first embodiment.

Figure 7A:
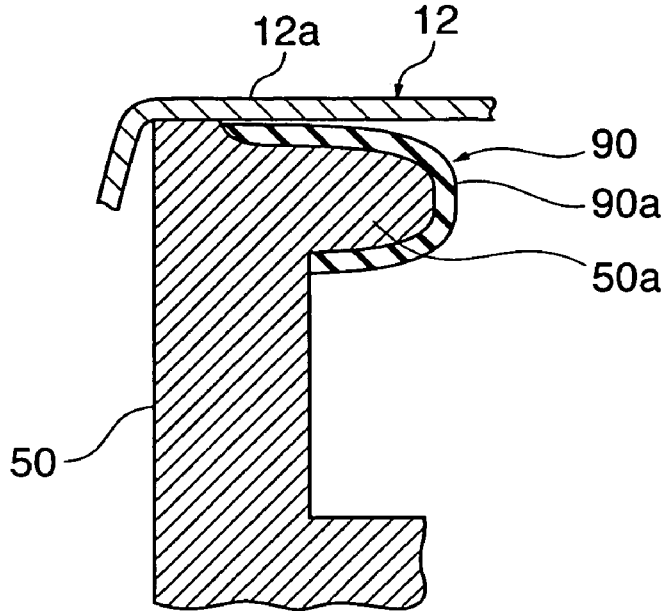
FIG. 7A is a fragmentary cross-sectional view of a hollow cylindrical drum shell of a percussion detecting apparatus according to a third embodiment of the present invention.
Figure 7B:
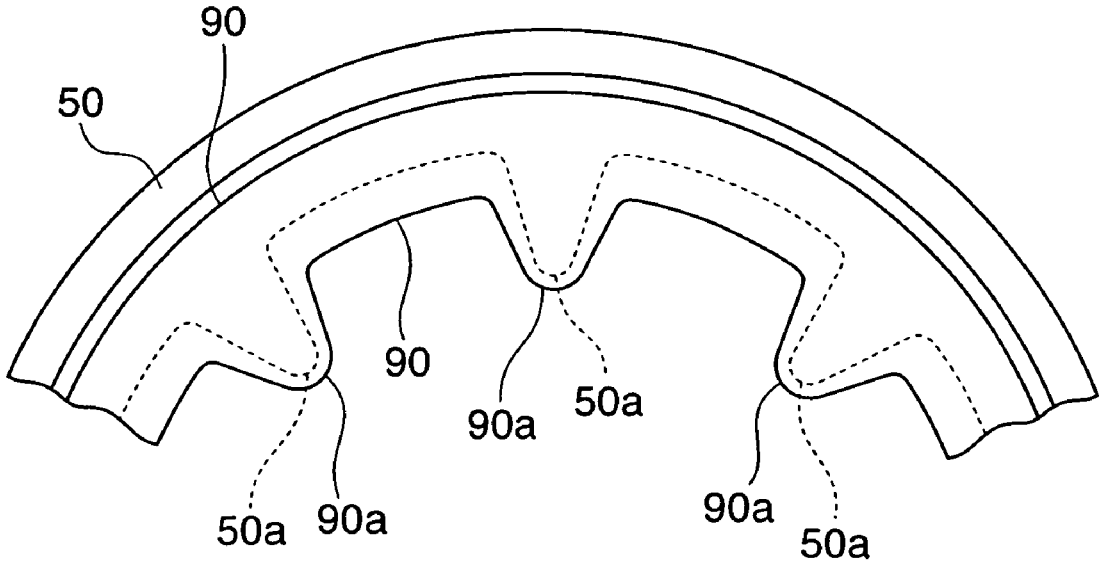
FIG. 7B is a partial plan view of the hollow cylindrical drum shell of the percussion detecting apparatus, with a head removed therefrom.

FIG. 7A is a fragmentary cross-sectional view of a hollow cylindrical drum shell of a percussion detecting apparatus according to the third embodiment. FIG. 7B is a partial plan view of the hollow cylindrical drum shell with the head 12 removed therefrom.

The drum shell 50 has an upper part thereof integrally formed with engaging projections 50*a* arranged at equal space intervals at a plurality of locations (e.g. eight locations) in a manner projecting inward. Further, on an inner upper part of the drum shell 50, a resilient member 90 formed e.g. of rubber for preventing vibration is disposed as a percussion surface support part for supporting the percussion surface part of the head 12. The resilient member 90 is formed into an annular shape in plan view, and has a plurality of projection-associated parts 90*a* formed in a manner associated with the respective engaging projections 50*a*. Each projection-associated part 90*a* is formed with a bag-like part for fitting on the associated engaging projection 50*a*. The engaging projections 50*a* are fitted in the respective associated bag-like parts, whereby the resilient member 90 is mounted on an upper inner wall surface of the drum shell 50.

In an unbeaten state of the percussion detecting apparatus with the resilient member 90 mounted in the drum shell 50, the projection-associated parts 90*a* are near or in contact with the lower surface of the periphery of the head 12, as shown in FIG. 7A. When a beat is applied, the projection-associated parts 90*a* come into abutment with the lower surface of the periphery of the head 12 to apply an adequate reaction force to the head 12. Thus, the resilient member 90 cooperates with the light radiating part 40 to suppress excessive resilience of the percussion surface 12*a* of the head 12 to thereby make percussion feeling closer to that obtained from an acoustic percussion instrument.

In the case where excessive resilience of the percussion surface 12*a* of the head 12 is suppressed by the light radiating part 40 alone as in the first embodiment, it is difficult to set resilience such that excellent vibration prevention and excellent sensing can be satisfactorily achieved at the same time. More specifically, insofar as the resilience of the light radiating part 40 is concerned, softness suitable for vibration prevention is different from softness suitable for sensing e.g. by the first and second switches sw1 and sw2, and therefore one of the two types of softness has to be sacrificed to some degree for the sake of the other depending on the case.

However, in the third embodiment, it is possible to provide the light radiating part 40 and the resilient member 90 with the reaction-generating function in a shared manner, thereby causing the two to generate reaction force properly. Thus, the light radiating part 40 can be configured to generate a certain amount of reaction force and reliably ensure excellent sensing at the same time, and on the other hand, the resilient member 90 can be configured to mainly generate a reaction force, thereby the whole reaction force is adjusted to the optimum.

According to the present embodiment, it is possible not only to provide the same advantageous effects as provided by the first embodiment, but also to make percussion feeling further closer to that obtained from an acoustic percussion instrument while maintaining reliability of sensing.

It should be noted that in the third embodiment, the light radiating part 40 can be replaced by one formed by configuring the light radiating part 140 in the second embodiment as a softer one.

In the first to third embodiments, the cross-sectional shapes of the respective tube bodies 41 and 81 are not limited to the exemplified ones, but they may be formed into any shape insofar as it has a hollow and can be easily resiliently bent. For example, an inverted U shape may be employed.

Next, a description will be given of a fourth embodiment of the present invention.

Figure 8:
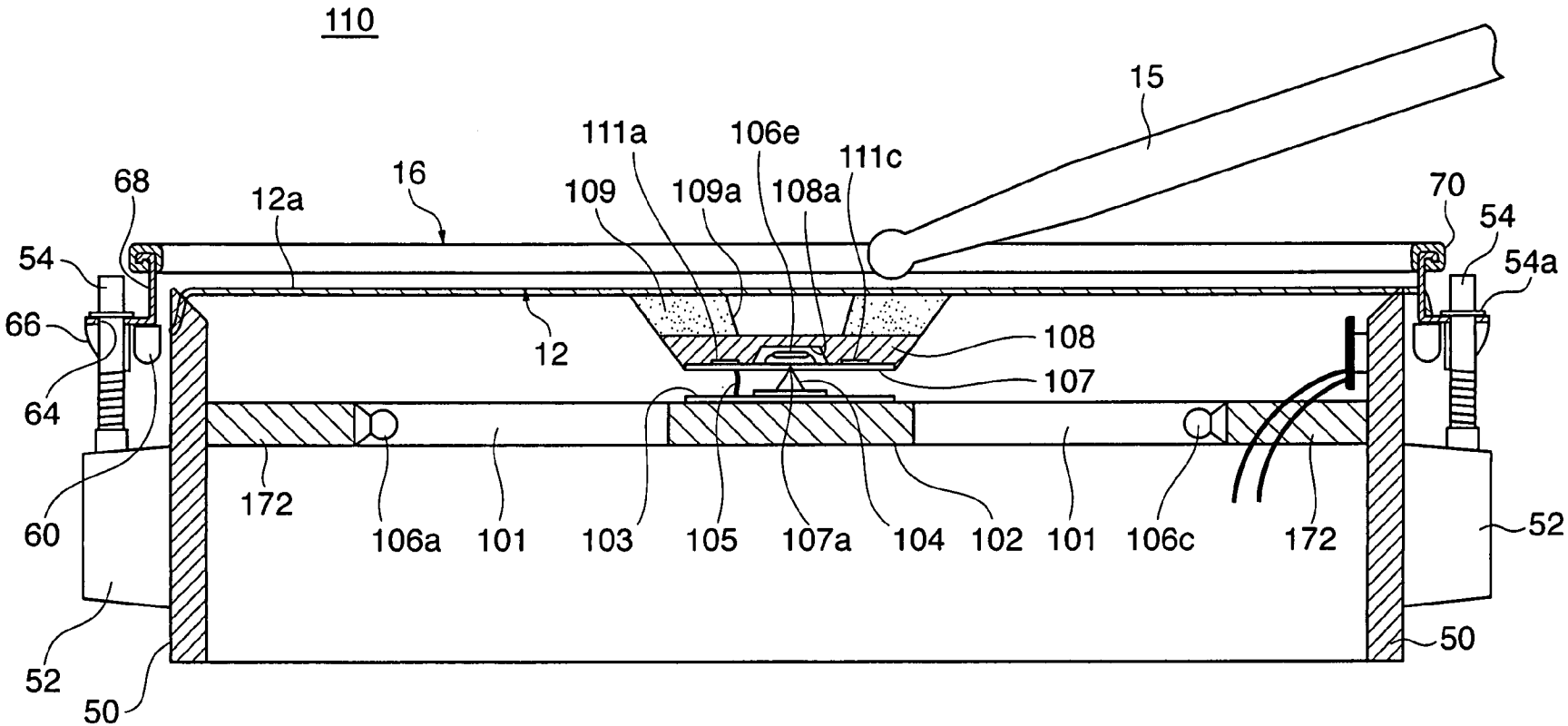
FIG. 8 is a cross-sectional view of a percussion detecting apparatus according to a fourth embodiment of the present invention.

FIG. 8 is a cross-sectional view of a percussion detecting apparatus according to the fourth embodiment and corresponds to FIG. 3. The percussion detecting apparatus 110 of the present embodiment is identical in appearance to the percussion detecting apparatus 10 of the first embodiment, but distinguished from the percussion detecting apparatus 10 by configuration for percussion detection and visual indication of a percussion pattern. Components corresponding to those in the first embodiment are designated by identical reference numerals, and description thereof is omitted.

Figure 9A:
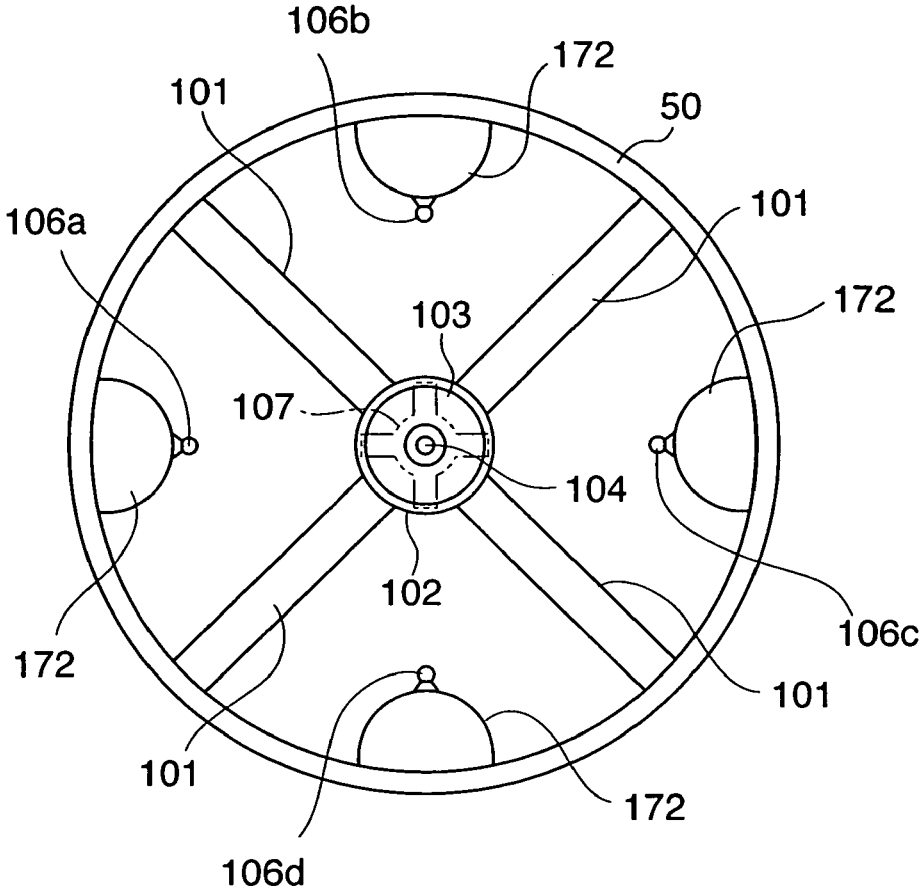
FIG. 9A is a plan view of a portion of the percussion detecting apparatus below a cross-shaped movable lever.
Figure 9B:
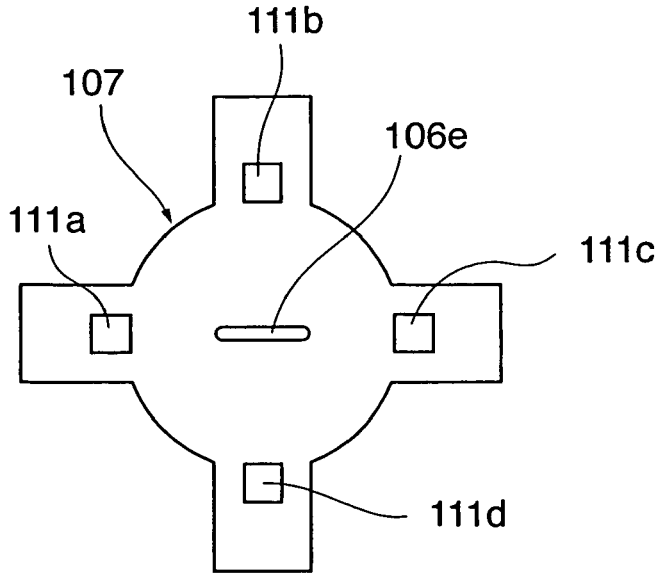
FIG. 9B is a plan view of the cross-shaped movable lever.

The percussion detecting apparatus 110 has a central fixed plate 102, and a cross-shaped movable lever 107. FIG. 9A is a plan view of a portion of the percussion detecting apparatus 110 below the cross-shaped movable lever 107, and FIG. 9B is a plan view of the cross-shaped movable lever 107.

As shown in FIGS. 8 and 9A, the central fixed plate 102 is supported at a central location in the drum shell by a plurality of bridges (e.g. four bridges) 101 extending from the inner periphery of the drum shell 50. Further, at respective locations within the drum shell 50, where interference with the bridges can be avoided, there are formed a plurality of LED support members (e.g. four members) 172 at equal space intervals such that they extend inward from the inner periphery of the drum shell 50. On the innermost ends of the respective LED support members 172, there are disposed LEDs 106*a* to 106*d* (hereinafter sometimes generically referred to as "the LEDs 106") which are capable of emitting light at high luminance levels. The lower end of the drum shell 50 is open, and the LEDs 106*a* to 106*d* are arranged such that they can be viewed not only from above (i.e. from a side of the percussion surface 12*a* of the head 12), but also from below (i.e. from a side opposite to the percussion surface 12*a*). Further, a base plate 103 is disposed on the central fixed plate 102, and a conical fulcrum part 104 is fixedly provided on the center of the base plate 103.

On the other hand, as shown in FIG. 8, the cross-shaped movable lever 107 is disposed on the lower surface of the central part of the head 12 via a soft resilient member 109 formed e.g. of sponge and a transparent resilient member 108 formed e.g. of silicone. As shown in FIG. 9B, an LED 106*e* is disposed on the upper surface of the central part of the cross-shaped movable lever 107. As shown in FIG. 8, the transparent resilient member 108 has a central lower part thereof formed with a recess 108*a*, and the LED 106*e* is accommodated in this recess 108*a*.

Further, the resilient member 109 has a central portion thereof formed therethrough with a through hole 109*a* having a diameter progressively increased toward the upper end thereof. The resilient member 109 is in the form of a doughnut whose cross-sectional shape is progressively increased toward the upper end thereof. The resilient member 109 is rather large, and the upper surface thereof is fixed to the lower surface of the head 12 in a large area, so that when a beat is applied to the head 12, vibration of the head 12 is properly suppressed, whereby excessively resilient action of the head 12 is prevented. Light emitted from the LED 106*e* can be viewed from above through the transparent resilient member 108 and the through hole 109*a*. The LEDs 106*a* to 106*e* form percussion pattern indicating means.

As shown in FIG. 9B, percussion sensors 111 (111*a* to 111*d*) each formed e.g. by a piezoelectric element or a variable resistor are affixed to four arms of the cross-shaped movable lever 107, respectively, at locations close to the respective proximal end portions of the four arms. Accordingly, the percussion sensors 111*a* and 111*c* are disposed at respective locations opposite to each other, and the percussion sensors 111*b* and 111*d* are disposed at respective locations opposite to each other, as viewed in plan view. Further, the percussion sensors 111*a* to 111*d* positionally correspond to the LEDs 106*a* to 106*d*, respectively. The intensity of light emitted from each of the LEDs 106 varies with the value of an output from the corresponding percussion sensor 111. The percussion sensors 111 and the LEDs 106 are each electrically connected to the base plate 103 by a lead line 105 (see FIG. 8).

As shown in FIG. 8, in the lower central surface of the cross-shaped movable lever 107, there is formed a recess 107*a* for having the tip (top end) of the conical fulcrum part 104 fitted therein. The tip of the conical fulcrum part 104 is constantly engaged in the recess 107*a* such that the cross-shaped movable lever 107 can move like a seesaw with the tip of the conical fulcrum part 104 as a fulcrum.

Each of the percussion sensors 111 outputs a signal corresponding to a pressure from the transparent resilient member 108, as a beat signal. When the head 12 is beaten, a percussion sensor 111 closer to the beat position outputs a more intense signal, and an arm of the cross-shaped movable lever 107 closer to the beat position shows a larger downward motion on the fulcrum of the tip of the conical fulcrum part 104.

Figure 10:
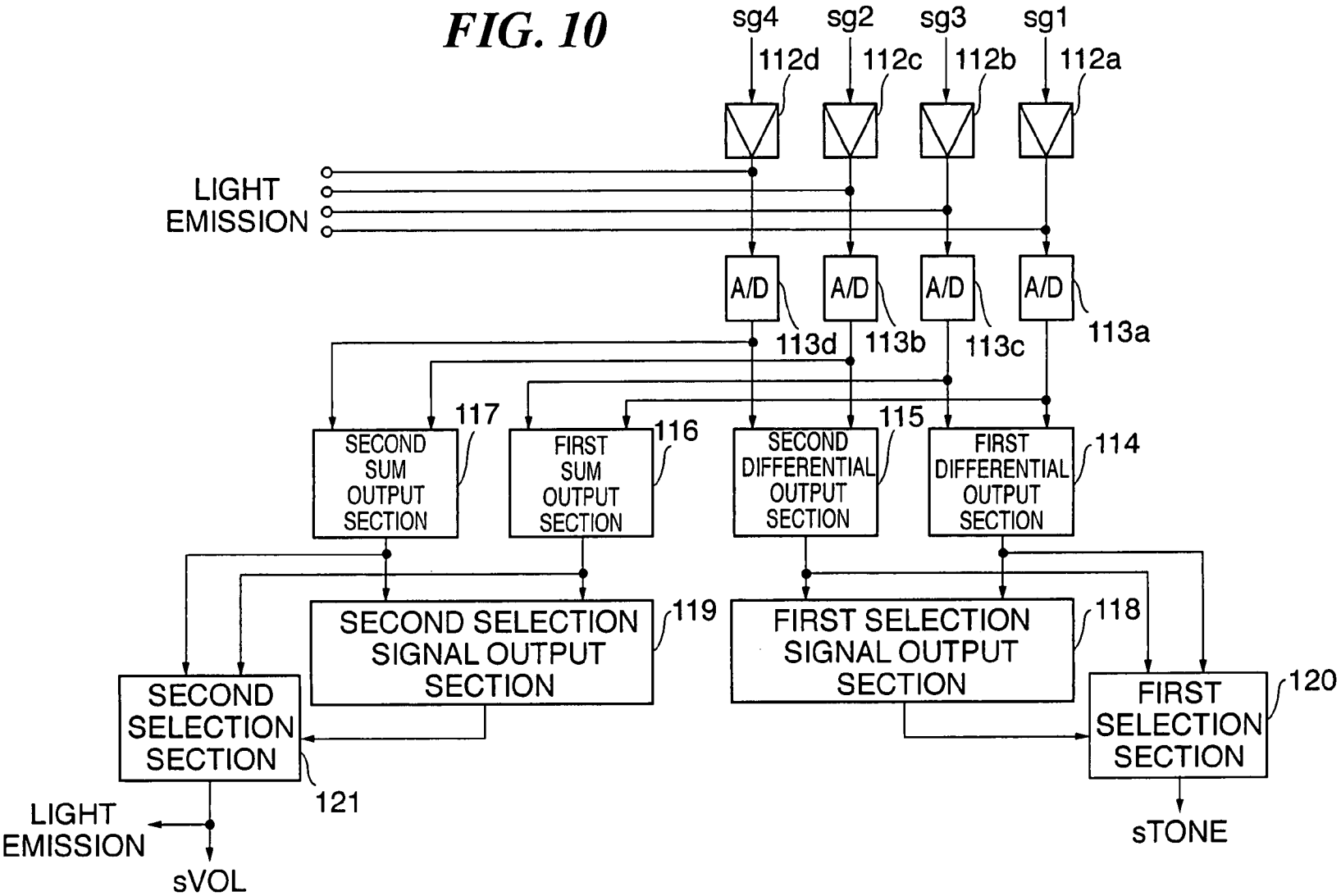
FIG. 10 is a block diagram useful in explaining functions related to visual indication and musical tone generation in the fourth embodiment.

FIG. 10 is a block diagram showing functions related to visual indication and musical tone generation in the present embodiment.

Output signals sg1 to sg4 from the respective percussion sensors 111*a* to 111*d* are input to A/D converters 113*a* to 113*d*, respectively, via respective associated amplifiers 112*a* to 112*d*. Outputs from the respective A/D converters 113*a* and 113*c* are input to a first differential output section 114 and a first sum output section 116. Then, the absolute value of a differential between the outputs from the two A/D converters 113*a* and 113*c* is output from the first differential output section 114 to a first selection signal output section 118 and a first selection section 120. On the other hand, a value obtained by adding the absolute values of the respective outputs from the two A/D converters 113*a* and 113*c* is output from the first sum output section 116 to a second selection signal output section 119 and a second selection section 121.

Similarly, outputs from the respective A/D converters 113*b* and 113*d* are input to a second differential output section 115 and a second sum output section 117. Then, the absolute value of a differential between the outputs from the two A/D converters 113*b* and 113*d* is output from the second differential output section 115 to the first selection signal output section 118 and the first selection section 120, and a value obtained by adding the absolute values of the respective outputs from the two A/D converters 113*b* and 113*d* is output from the second sum output section 117 to the second selection signal output section 119 and the second selection section 121.

The first selection signal output section 118 compares the two input values. Then, the first selection signal output section 118 outputs "1" to the first selection section 120 only when the output from the first differential output section 114 is larger than that from the second differential output section 115, and otherwise, outputs "0" to the first selection section 120. If the signal from the first selection signal output section 118 is "1", the first selection section 120 selects the output from the first differential output section 114, whereas if the signal from the first selection signal output section 118 is "0", the first selection section 120 selects the output from the second differential output section 115. In short, the value of the larger one of the two outputs from the first differential output section 114 and the second differential output section 115 is output as a signal sTONE.

Similarly, the second selection signal output section 119 outputs "1" to the second selection section 121 only when the output from the first sum output section 116 is larger than that from the second sum output section 117. Based on the signal from the second selection signal output section 119, the second selection section 121 outputs the value of the larger one of the two outputs from the first sum output section 116 and the second sum output section 117, as a signal sVOL.

The signal sTONE and the signal sVOL are input to the DSP 22 (see FIG. 1). Then, musical tone generation and musical tone control are performed under the control of the CPU 4. First, a musical tone is generated by using the signal sVOL as a trigger, and the volume of the musical tone is controlled based on the value of the signal sVOL. Further, the tone color of the generated musical tone is controlled based on the value of the signal sTONE. For example, the tone color is controlled to contain many high-frequency components by setting the cut-off frequency of a low-pass filter to a higher value as the value of the signal sTONE is larger, but this is not limitative.

It should be noted that other musical tone parameters may be controlled based on the signal sTONE or the signal sVOL. For example, control of PAN or cycles of swinging PAN may be controlled.

Insofar as visual indication of a percussion pattern is concerned, based on the output signals sg1 to sg4 from the percussion sensors 111*a* to 111*d*, the LEDs 106*a* to 106*d* emit light at respective luminance levels corresponding to the values of the output signals sg1 to sg4, and based on the signal sVOL, the LED 106*e* emits light at a luminance level corresponding to the value of the signal sVOL.

For example, let it be assumed that a beat is applied to the head 12 at a position closer to the LED 106*a* than to the center of the head 12 and slightly closer to the LED 106*b* than to the LED 106*d*, and numerical values representing the magnitudes of the output signals sg for convenience of description are e.g. sg1=8, sg2=6, sg3=2, and sg4=3, the first selection section 120 outputs a signal based on a differential "6" between the output signals sg1 and sg3, as the signal sTONE, and the second selection section 121 outputs a signal based on a sum "10" of the output signals sg1 and sg3, as the signal sVOL.

Therefore, a musical tone with a volume corresponding to the sum "10" is sounded in a tone color corresponding to the differential "6". As a consequence, the beat position is aurally recognized by the tone color. In parallel with this, the LED 106*e* emits light at a luminance level corresponding to the sum "10", and the LEDs 106*a* to 106*d* emit light at respective luminance levels corresponding to "8", "6", "2", and "3" as the values of the output signals sg1 to sg4. As a consequence, the beat position is visually recognized.

It should be noted that a percussion sensor similar to the percussion sensor 111 may be also provided in the center of the cross-shaped movable lever 107 or the like position corresponding to the center of the head 12. In this case, sounding of a musical tone is triggered by an output from this percussion sensor, and the volume of the musical tone is determined by the output. Further, the LED 106*e* may be illuminated based on the output from this percussion sensor at a luminance level corresponding to the output.

Figure 11:
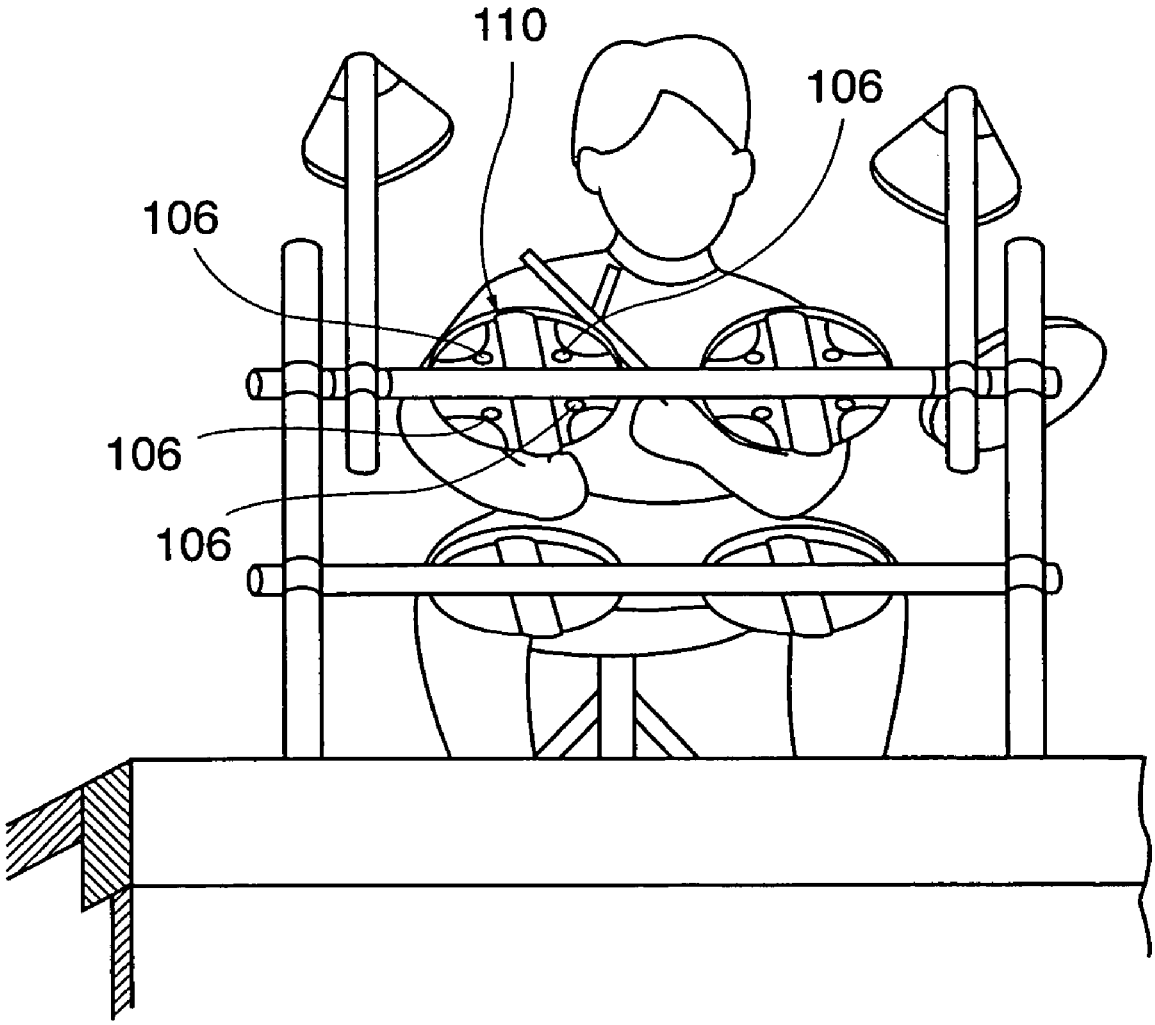
FIG. 11 is a view of the appearance of an electronic percussion instrument apparatus to which is applied the percussion detecting apparatus according to the fourth embodiment, in a state being played for musical performance.

FIG. 11 is a view of the appearance of an electronic percussion instrument apparatus to which is applied the percussion detecting apparatus 110 according to the present embodiment, in a state being played for musical performance. As shown in FIG. 11, when the electronic percussion instrument apparatus is being played on a stage, the reverse side of the percussion detecting apparatus 110 is viewed by the audience. Therefore, visual indication of percussion patterns by light emission from the LEDs 106*a* to 106*d* is viewed not only by a player, but also by the audience.

According to the present embodiment, it is possible to provide the same advantageous effects as provided by the first embodiment, by providing excellent percussion feeling by maintaining adequate resilience of the head 12 while suppressing excessive resilience of the same, and visually indicating a percussion pattern of a beat applied to the percussion surface. In addition, it is possible to generate each musical tone in a tone color corresponding to a percussion pattern, thereby serving for percussion practice as well as making the practice more enjoyable.

Further, since the visual indication by the LED 106 can be viewed not only from above, but also from below, it is possible to enhance visual effects in stage performance.

Furthermore, since the resilient member 109, the transparent resilient member 108, the cross-shaped movable lever 107, and the percussion sensors 111 are all arranged below the central part of the head 12, not only for detection of percussion, but also for prevention of excessively resilient action of the head 12, it is possible to make the apparatus compact in size.

Figure 12:
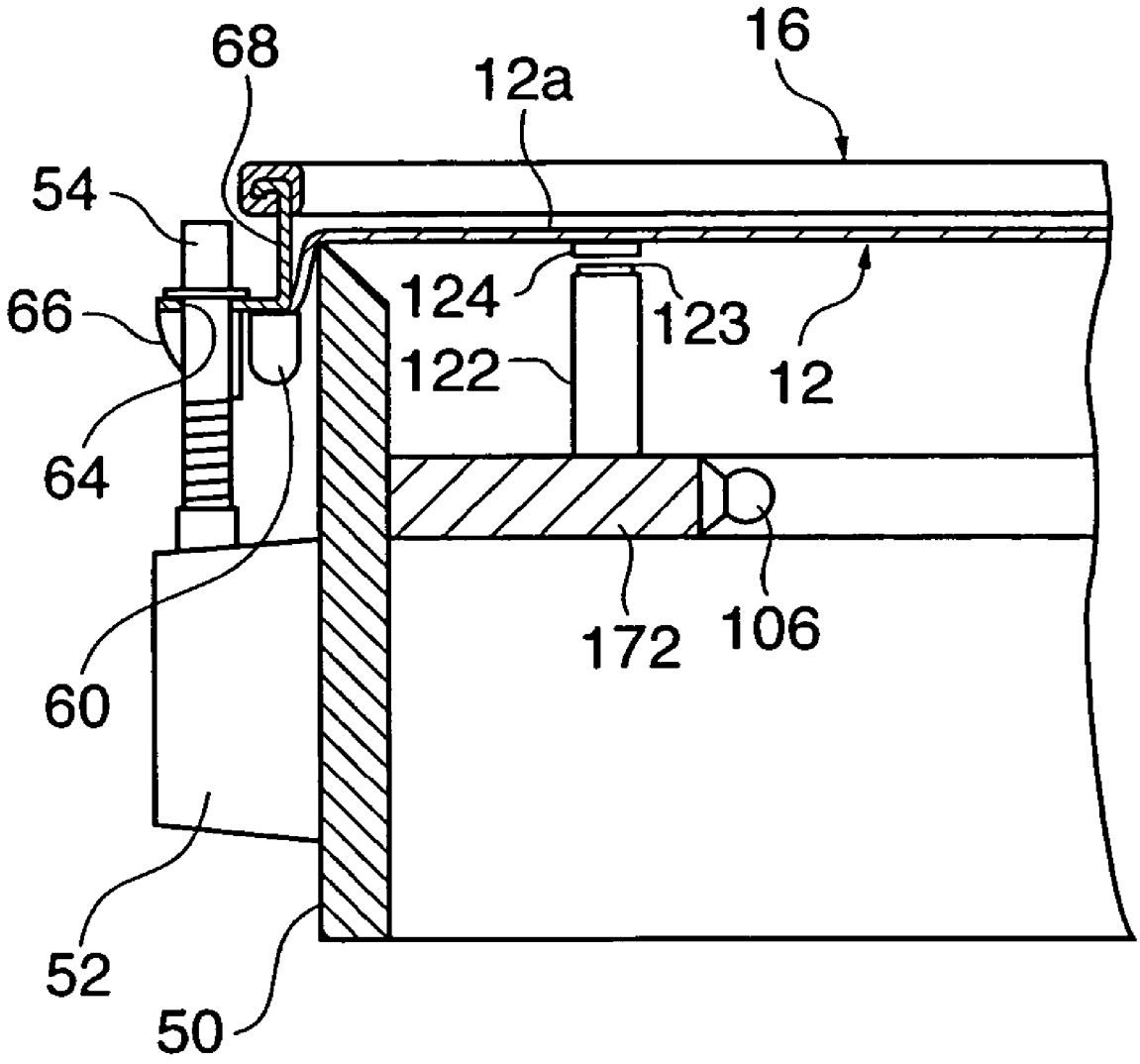
FIG. 12 is a cross-sectional view of a variation of the percussion sensor according to the fourth embodiment.

Although in the present embodiment, the percussion sensors 111 are provided on the cross-shaped movable lever 107, this is not limitative, but they may be circumferentially arranged within the drum shell 50 at equal space intervals. For example, as shown in FIG. 12, sensor support members 122 are provided on four LED support members 172, respectively, and photoreflectors 123 each formed of a pair of a light emitting element (e.g. an LED), not shown, and a light receiving element, not shown, are disposed on the upper ends of the respective sensor support members 122. Further, reflective parts 124 are formed on the lower surface of the head 12 at respective locations corresponding to the LED support members 172. In this case, signals output from the light receiving elements of the respective photoreflectors 123 according to respective light receiving levels, as in the photoreflectors 46 (see FIG. 4B), are used as percussion signals in place of the output signals sg1 to sg4 from the percussion sensors 111*a* to 111*d*.

Next, a description will be given of a fifth embodiment of the present invention.

Figure 13A:
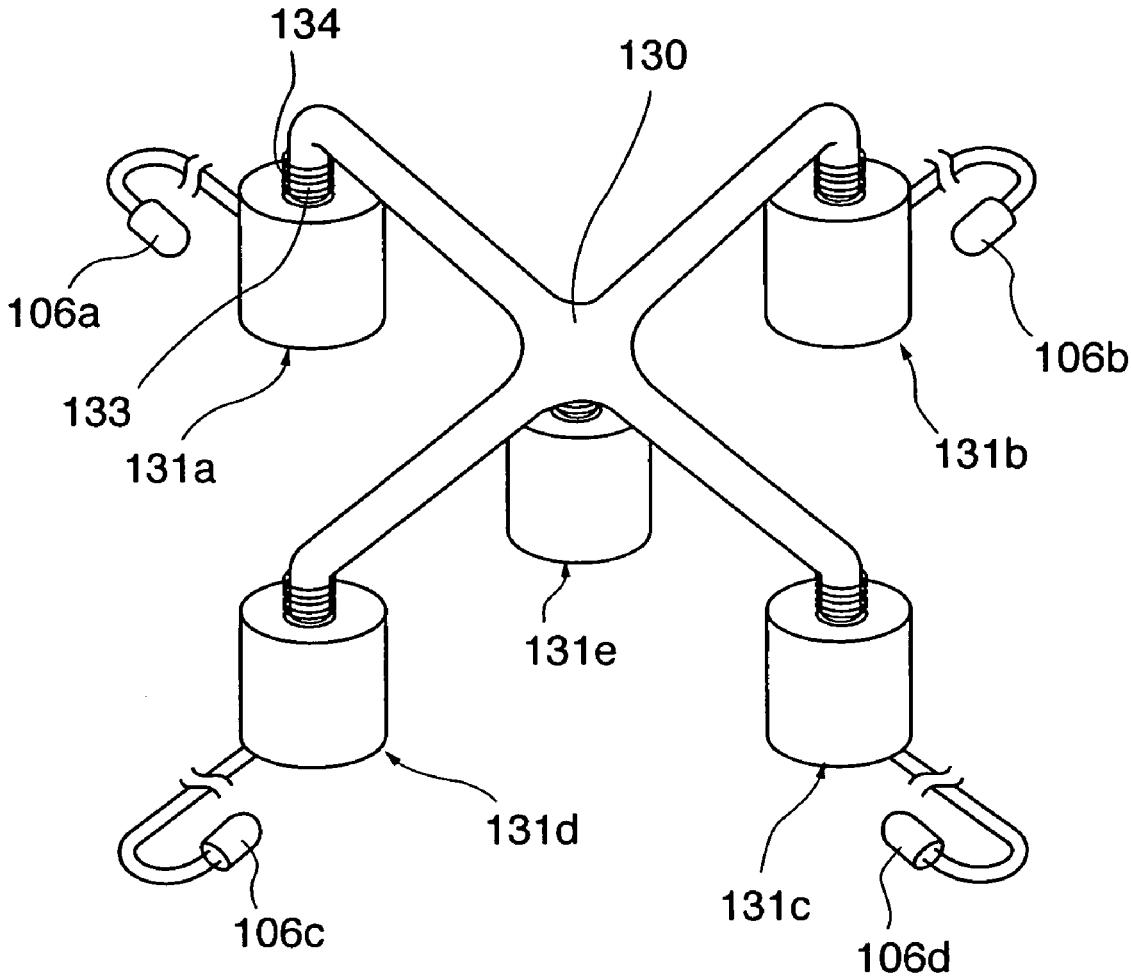
FIG. 13A is a perspective view of a percussion detecting mechanism of a percussion detecting apparatus according to a fifth embodiment of the present invention.
Figure 13B:
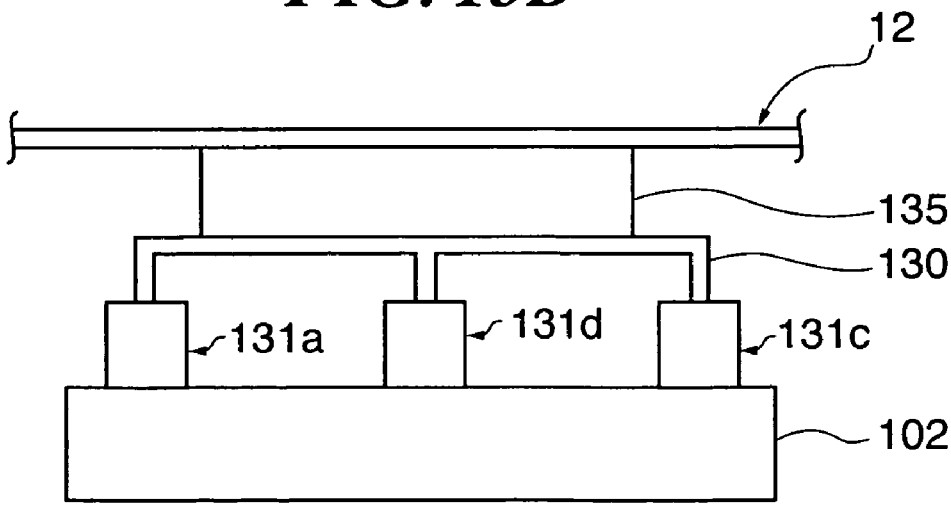
FIG. 13B is a fragmentary side view of the percussion detecting mechanism.

FIG. 13A is a perspective view showing a percussion detecting mechanism of a percussion detecting apparatus according to the fifth embodiment, and FIG. 13B is a fragmentary side view of the percussion detecting mechanism.

The present embodiment is distinguished from the fourth embodiment by the percussion detecting mechanism. In the present embodiment, the mechanism shown in FIGS. 13A and 13B is employed in place of the resilient member 109, the transparent resilient member 108, the cross-shaped movable lever 107, the percussion sensors 111, and so forth. Components corresponding to those in the fourth embodiment are designated by identical reference numerals, and description thereof is omitted.

A cross-shaped movable lever 130 has four arms extending from the center thereof in four directions, respectively, and motion detectors 131 (131*a* to 131*e*) identical in construction are provided at the respective lower ends of the four arms of the cross-shaped movable lever 130 and a central part of the same, respectively. The motion detectors 131 are fixed to the central fixed plate 102. As shown in FIG. 13B, the cross-shaped movable lever 130 is rigidly fixed on the lower surface of the head 12 via a soft and transparent resilient member 135, so that percussion applied to the head 12 is transmitted to the cross-shaped movable lever 130. Similarly to the resilient member 109, the resilient member 135 performs not only the function of transmitting percussion, but also the function of suppressing excessive resilience.

Within each of the motion detectors 131, there are provided a solenoid coil, not shown, and a ferrite core 133 that moves in a manner interlocked with the motion of the corresponding arm of the cross-shaped movable lever 130. The ferrite core 133 is vertically movable within the solenoid coil. The four arms are constantly urged upward by respective coil springs 134, so that each of the arms returns to its original position immediately after application of a beat.

When the head 12 is beaten to move each of the four arms of the cross-shaped movable lever 130 downward in an amount corresponding to the beat position, the ferrite cores 133 move relative to the respective solenoid coils, whereby electromotive force due to electromagnetic induction is generated from each of the motion detectors 131*a* to 131*d*.

In musical tone generation, electromotive forces generated from the respective motion detectors 131*a* to 131*d* are used similarly to the output signals sg1 to sg4 in the fourth embodiment so as to perform musical tone control (see FIG. 10). On the other hand, in visual indication, the LEDs 106*a* to 106*e* emit light based on electromotive forces generated from the respective motion detectors 131*a* to 131*e*. It should be noted that there may be provided an amplifier between a motion detector 131 and an LED 106. Further, the motion detector 131*e* may be dispensed with or disused, and the sum of the electromotive forces generated from the motion detectors 131*a* to 131*d* may be used, similarly to the output signals sg1 to sg4 in the fourth embodiment, for light emission from the LED 106*e*.

According to the present embodiment, it is possible to provide the same advantageous effects as provided by the fourth embodiment. Further, since the LEDs 106 emit light using the electromotive forces generated from the motion detectors 131*a* to 131*d*, power supply for light emission can be dispensed with.

Insofar as capability of visual indication by light emission is concerned, the percussion detecting mechanism and the light emitting mechanism shown in FIGS. 13A and 13B can be applied to acoustic musical instruments. For example, if a drum is formed to have a transparent drumhead and the above described mechanisms are provided in the drum, an acoustic percussion instrument which twinkles or gleams can be realized.

In the present embodiment as well, the percussion sensors 111 shown in the fourth embodiment may be provided in addition to the mechanisms shown FIGS. 13A and 13B such that the LEDs 106 can emit light for visual indication, based on electromotive forces generated from the motion detectors 131, and musical tone control can be performed for musical tone generation, based on outputs from the percussion sensors 111.

Next, a description will be given of a sixth embodiment of the present invention.

In the sixth embodiment, a percussion detecting apparatus has a percussion surface part held not at the outer peripheral part thereof, but at the central part thereof.

Figure 14A:
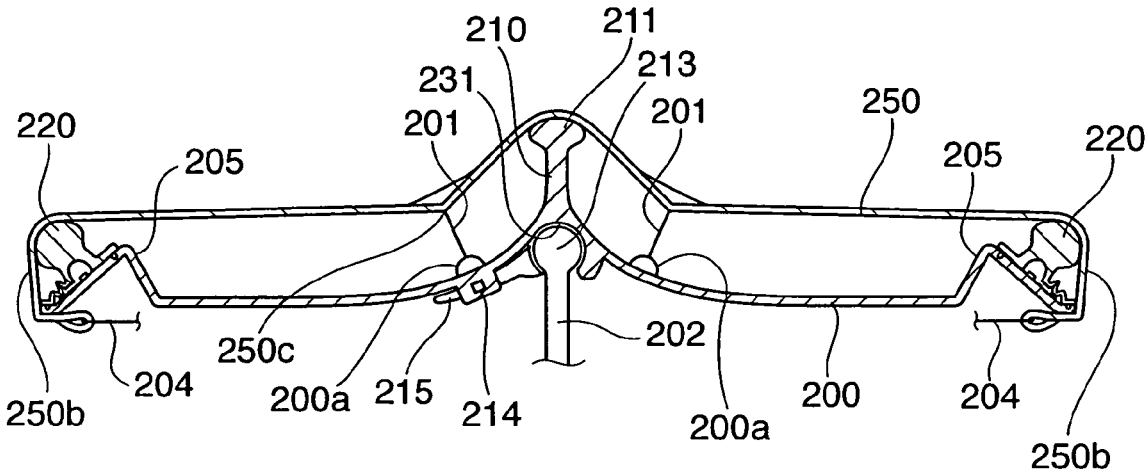
FIG. 14A is a cross-sectional view of a percussion detecting apparatus according to a sixth embodiment of the present invention.
Figure 14B:
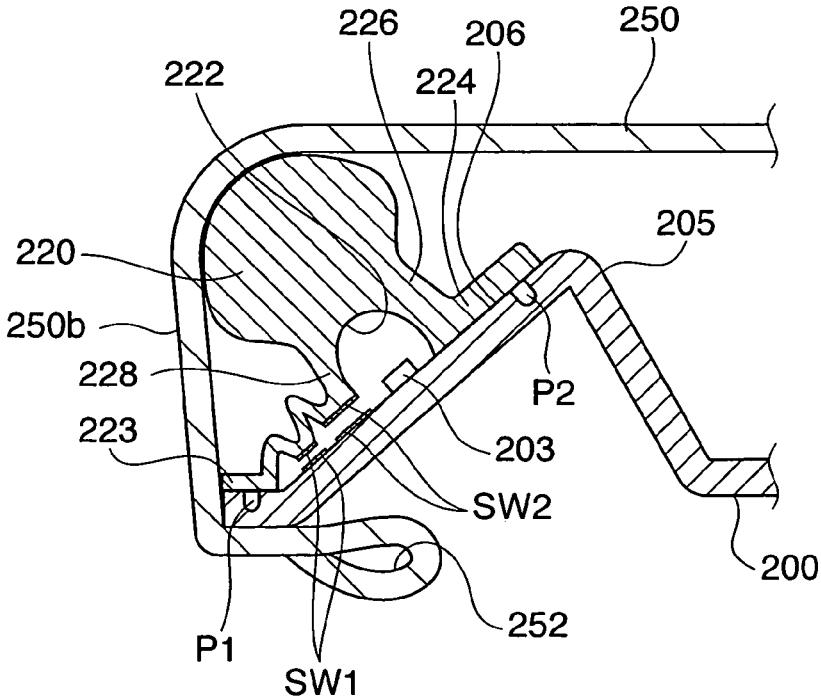
FIG. 14B is an enlarged cross-sectional view of an outer peripheral part of the percussion detecting apparatus.
Figure 15:
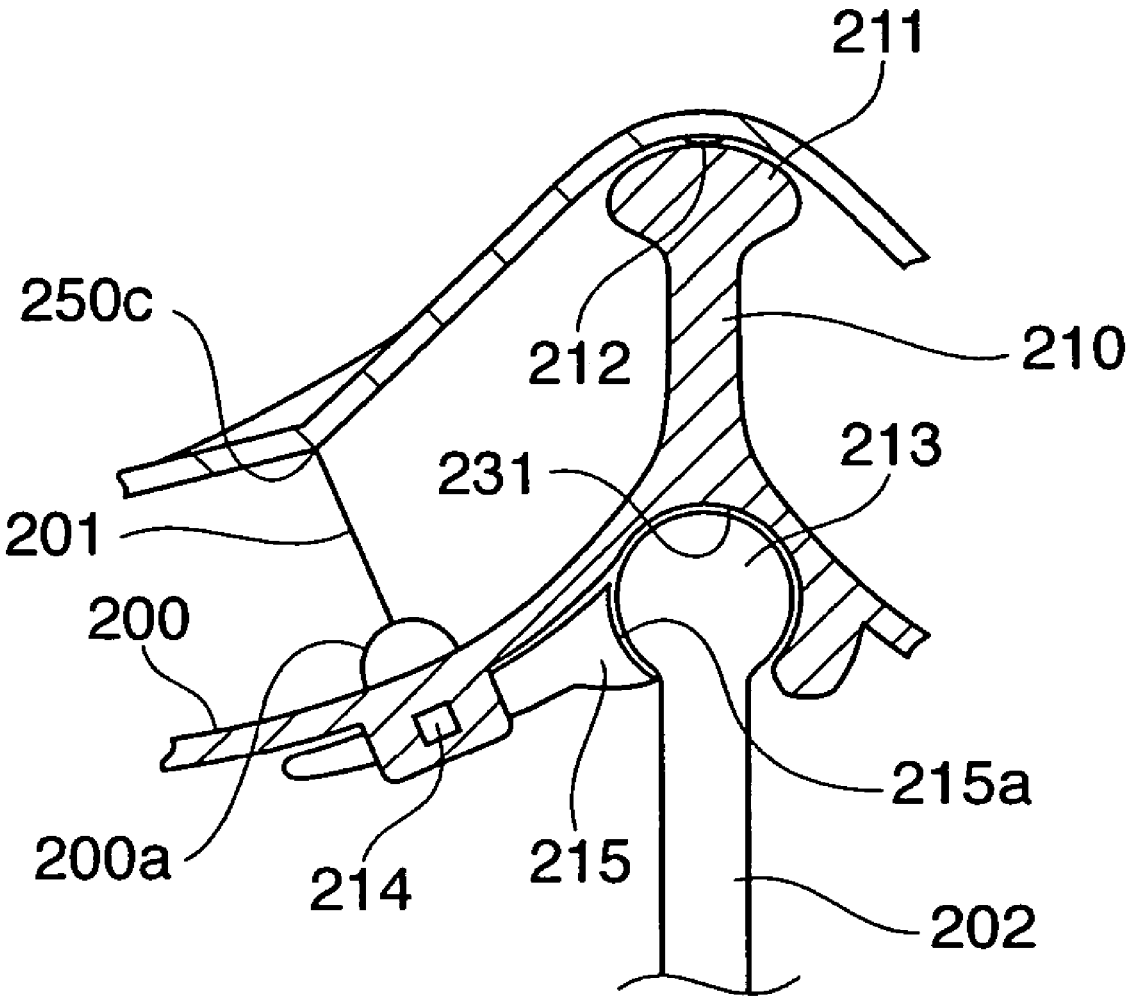
FIG. 15 is an enlarged cross-sectional view of a central part of the percussion detecting apparatus.

FIG. 14A is a cross-sectional view of the percussion detecting apparatus according to the sixth embodiment, and FIG. 14B is an enlarged cross-sectional view of the outer peripheral part of the percussion detecting apparatus. FIG. 15 is an enlarged cross-sectional view of the central part of the percussion detecting apparatus.

As shown in FIGS. 14A and 14B, the percussion detecting apparatus of the present embodiment has a mesh percussion surface part 250, which is formed of an air-permeable material, supported on a transparent frame 200. The percussion surface part 250 is formed into a cymbal-shape in which a central part thereof, in plan view, projects upward. As a whole, the percussion detecting apparatus has a circular shape in plan view in the present embodiment, but it may be formed into a polygonal shape. The transparent frame 200 has an outer peripheral part thereof formed with an annular projection 205 projecting toward the percussion surface part 250. On an outer sloped surface 206 of the annular projection 205, a plurality of holding members 220 each having a scattered light generator and touch response switch formed of a transparent resilient resin are circumferentially arranged at equal space intervals. The holding member 220 is formed by a resilient member formed of a light-permeable resin.

The holding member 220 has a dome-shaped recess 222 formed in a lower surface thereof approximately opposed to a central part of the outer sloped surface 206, and an LED 203 is disposed on the outer sloped surface 206 in facing relation to the dome-shaped recess 222. At a location outward (left lower side as viewed in FIG. 14B) of the LED 203 on the outer sloped surface 206, there are provided switches SW1 and SW2 of a two-make type each having a pair of a fixed contact and a movable contact. Further, the holding member 220 has base parts 223 and 224 from which projections P1 and P2 project, respectively. These projections P1 and P2 are fitted in the outer sloped surface 206 of the transparent frame 200, whereby the holding member 220 is attached to the transparent frame 200.

The central part of the transparent frame 200 is supported by a support shaft 202 fixed e.g. to a base member, not shown. As shown in FIG. 15, the support shaft 202 has an upper part thereof formed as a hemispherical projection 213, and the lower surface of the central part of the transparent frame 200 is formed as a held part 231. The held part 231 has its solid angle changed by operation of a lever 214.

More specifically, when the lever 214 is operated radially inward (toward the center of the transparent frame 200), a moving member 215 moves radially outward (toward the outer periphery of the transparent frame 200), and when the lever 214 is operated outward, the moving member 215 moves radially inward. The moving member 215 has a hemispherical projection-side end part 215*a* formed into a recessed shape conforming to the hemispherical projection 213. When the moving member 215 is moved away from the hemispherical projection 213 by operation of the lever 214, the held part 231 opens to release fitting of the hemispherical projection 213 in the held part 231. On the other hand, when the moving member 215 is brought into contact with the hemispherical projection 213 by operation of the lever 214 to press the hemispherical projection 213, the held part 231 fits in the hemispherical projection 213, whereby the transparent frame 200 is supported by the hemispherical projection 213.

As shown in FIG. 14A, together with the percussion surface part 250, the transparent frame 200 generally form a hill-like shape in side view with its central portion protruded upward. The transparent frame 200 has a central support 210 projecting upward from the center thereof, and the percussion surface part 250 is supported by the central support 210 such that the central part of the percussion surface part 250 protrudes upward. More specifically, as shown in FIG. 15, the central support 210 has an upper end formed as a hemispherical holding part (central holding part) 211, and a pressure sensor 212 is disposed on the hemispherical holding part 211. The pressure sensor 212 is attached to the hemispherical holding part 211 in a manner embedded in a resilient sheet, not shown. The pressure sensor 212 is implemented e.g. by a piezoelectric sensor or a contact resistance sensor. The pressure sensor 212 is covered from above by the percussion surface part 250 in a manner sandwiched between the percussion surface part 250 and the hemispherical holding part 211.

The percussion detecting apparatus is assembled as follows:

First, the holding member 220 is attached to the transparent frame 200. Then, the percussion surface part 250 is overlaid on these, and near central portions of the percussion surface part 250 disposed around the central support 210 and predetermined near central portions 200*a* of the transparent frame 200 are bound by a plurality of string members 201 such as strings or wires (see FIG. 14A) and pulled downward. The string member 201 has one end thereof coupled to a mesh material and another end thereof fixed to the predetermined portion 200*a* of the transparent frame 200. Further, the held part 231 and the hemispherical projection 213 are fitted with each other by operation of the lever 214. A hole 252 (see FIG. 14B) through which a string member 204 is passed is formed in the peripheral edge part of the percussion surface part 250 in a manner extending substantially over the entire circumference of the percussion surface part 250. The peripheral edge part of the percussion surface part 250 covers the outer part of the holding member 220. The hole 252 has an opening from which the string member 204 is circumferentially passed. When the string member 204 is passed through the hole 252 via the opening, and the both ends of the string 204 are tied together while tightening the string member 204, the percussion surface part 250 is stretched tight.

The degree of sensitivity for sensing and the tension of the percussion surface part 250 can be both adjusted by changing the degree of tightening of the string member 204. More specifically, when the string member 204 is firmly tied, the percussion surface part 250 is stretched tight, and the holding member 220 slightly shrinks, which improves the sensitivity. As the degree of tightening of the string member 204 is higher, the rate of increase in the solid angle at which the dome-shaped recess 222 receives light emitted from the LED 203 becomes higher. Further, the higher the degree of tightening of the string member 204 is, the smaller the difference between the ON timing of the switch SW1 and that of the switch SW2 becomes. When the string 204 is fixed in a loosened state, it is possible to provide a "non-sensitive zone" where the switches SW1 and SW2 are not turned on by a weak beat applied to the percussion surface.

Although in the present embodiment, it is assumed that percussion is concentrated on the outer peripheral part of the percussion surface part 250, this is not limitative, but the central part of the percussion surface part 250 or a portion of the same between the central part and the outer peripheral part may be beaten. Consequently, depending on the beat position, sometimes both the switches SW1 and SW2 and the pressure sensor 212 are turned on, and sometimes the switches SW1 and SW2 or the pressure sensor 212 is turned on. In either of the cases, since light passes through both the percussion surface part 250 and the holding member 220, the holding member 220 is seen intensely illuminated during application of percussion.

The resin forming the holding member 220 contains a light scattering agent, so that when the solid angle at which light is received from the LED 203 increases, the amount of incoming light also increases. The incoming light is scattered by the light scattering agent, whereby the whole holding member 220 is illuminated. Therefore, although the LED 203 constantly emits light, when a beat is applied, the amount of light that enters the holding member 220 is increased to make the holding member 220 brighter in appearance. Light emitted from the holding member 220 can be viewed from above the percussion surface part 250. Further, due to the transparency of the transparent frame 200, light emitted from the holding member 220 can also be viewed from below the holding member 220. It should be noted that the LED 203 may be configured to emit light only when the switch SW1 or SW2 is turned on, instead of emitting light constantly.

According to the present embodiment, it is possible to provide the same advantageous effects as provided by the first embodiment.

The outer peripheral part of the head surface 250 also functions as a rim percussion part. In this case, mechanical noise generated due to percussion is prevented from being output as large sound. Therefore, electrically processed tones can be mainly heard, which makes the tones close to real rim percussion sound.

Next, a seventh embodiment of the present invention will be explained with reference to FIGS. 16A to 16C.

Figure 16A:
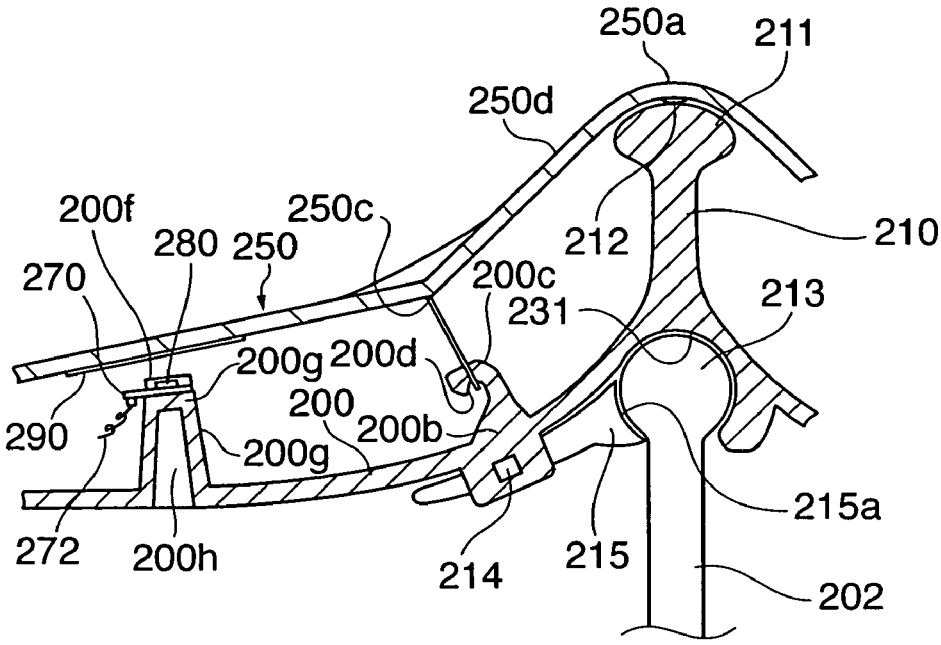
FIG. 16A is a fragmentary enlarged section view of a cymbal-shaped percussion detecting apparatus according to a seventh embodiment of the present invention.
Figure 16B:
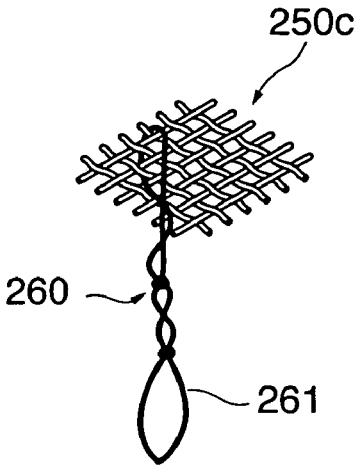
FIG. 16B is a fragmentary enlarged perspective view showing an intermediate portion of a percussion surface part of the percussion detecting apparatus.
Figure 16C:
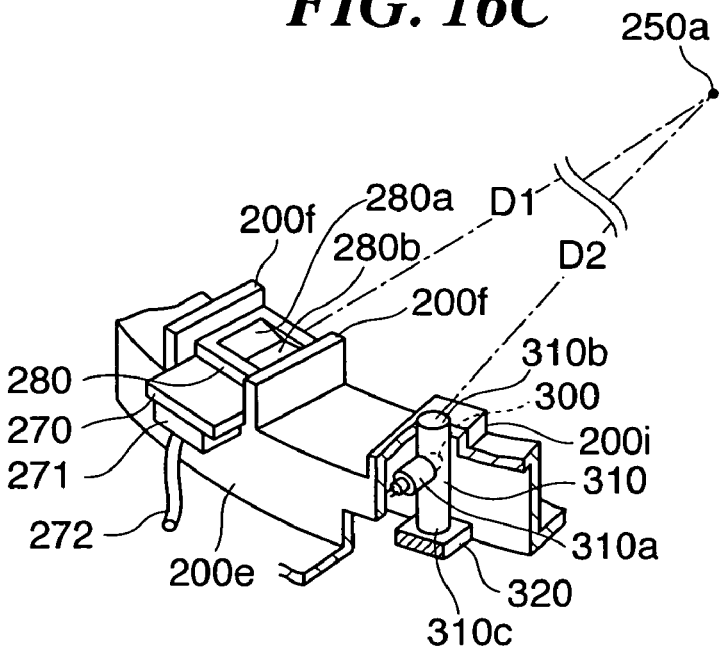
FIG. 16C is a fragmentary enlarged perspective view showing a sensor support of a transparent frame and a contactless sensor and an LED for visual indication that are provided on the sensor support.

FIG. 16A is a fragmentary enlarged section view of a cymbal-shaped percussion detecting apparatus according to the seventh embodiment, FIG. 16B is a fragmentary enlarged perspective view showing an intermediate portion of a percussion surface part of the percussion detecting apparatus and an extension member for pulling the intermediate portion of the percussion surface part toward a transparent frame, and FIG. 16C is a fragmentary enlarged perspective view showing a sensor support of the transparent frame and a contactless sensor and an LED that are provided on the sensor support.

The percussion detecting apparatus of the present embodiment is basically the same in construction as the above-mentioned sixth embodiment, and is characterized in that it can easily be shaped into a cymbal-type mesh drum for easy manufacture of the apparatus, a user is permitted to play a one-hand flam, and second and/or third triggers in the flam play can reliably be detected for visual indication. In FIGS. 16A through 16C, parts denoted by like numerals as those in FIG. 15 are the same in construction as like parts of the sixth embodiment, and explanations thereof will be omitted.

The percussion surface part 250 has a central part 250*a* located above the central holding part 211 of the central support 210, a peripheral part 250*b* (shown in FIG. 14A), and an intermediate part located between the central part 250*a* and the peripheral part 250*b* at a distance as large as one fifth to half of the radius of the percussion surface part 250, the distance being measured from the center of the percussion surface part 250 and being, for example, one fourth of the radius of the percussion surface part.

To easily form the percussion surface part 250 into a cymbal shape, the percussion surface part 250 of the present embodiment is designed that a lower surface portion 250*c* of the intermediate part of the percussion surface part is pulled toward and fixed to the transparent frame (holding part) 200 by means of an extension member 260. A portion of mesh which forms the lower surface portion 250*c* of the percussion surface part 250 may be extended downward, instead of using the extension member 260.

As shown in FIG. 16B, the extension member 260 has one end thereof knitted into the mesh forming the lower surface portion 250*c* of the percussion surface part 250, and another end thereof formed into a loop that forms an engaging loop portion 261. As shown in FIG. 16A, at a location where the transparent frame 200 is opposed to the extension member 260, the transparent frame 200 is provided with an engaging piece 200*b* extending upward. An engaging recess 200*d* is formed in a head 200*c* of the engaging piece 200*b*, and the engaging loop portion 261 of the extension member 260 is engaged with the engaging recess 200*d*. The intermediate portion of the percussion surface part 250 can be held at a vertical position close to the transparent frame 200 by pulling the engaging loop portion 261 of the extension member 260 downward and by engaging the same with the engaging recess 200*d* formed in the engaging piece 200*b* of the transparent frame 200, whereby the percussion surface part 250 has a cymbal-shaped raise part 250*d*. The extension member 260 constitutes an intervening member interposed between the lower surface portion 250*c* of the percussion surface part 250 and the transparent frame 200.

In the present embodiment, three or more extension members 260 are provided in the lower surface portion 250*c* of the percussion surface part 250. To obtain a more real cymbal shape, it is preferable that eight or more extension members 260 be provided.

It is unnecessary to strictly determine the length of the extension member 260 measured in the vertical direction of the apparatus. That is, the extension member 260 can have any length so long as the engaging loop portion 261 of the extension member 260 can be engaged with the engaging recess 200*d* of the transparent frame 200. The percussion surface part 250 can subsequently be stretched by pulling a string member 204 toward the center of the percussion surface part.

The extension member 260 may be very short in length. In this case, the extension member 260 is only comprised of an engaging member for pulling the percussion surface part 250 downward and fixing the same to the transparent frame 200.

Next, a percussion detecting section and a visual indication section of the percussion detecting apparatus of the present embodiment will be explained.

As mentioned above, the percussion detecting apparatus is formed into a cymbal-shaped mesh drum. At an intermediate portion between the central part 250 of this cymbal and the peripheral part thereof (shown at reference numeral 250*b* in FIG. 14), an annular floor part 200*e* is formed so as to project upwardly from the transparent frame (holding part) 200. The annular floor part 200*e* is provided with a plurality of (e.g., eight) pairs of protectors 200*d* spaced at equal intervals circumferentially of the transparent part 200. The floor part 200*e* between each pair of the protectors 20*f* constitutes a sensor support (sensor part supporting section) 200*g* on which a sensor circuit board 270 is disposed. The sensor circuit board 270 has an outer edge portion that extends radially outwardly of the transparent frame 200 beyond a radially outer surface of the sensor support 200*g*. The sensor circuit board 270 is provided at its outer edge portion with a terminal 271 to which lead wires 272 are connected. Wall ribs 200*h* as reinforcing members are formed between inner and outer peripheral walls of the annular floor part 200*e* corresponding to the sensor supports 200*g*.

The sensor circuit board 270 has a surface thereof opposed to the mesh percussion surface part 250, to which a contactless sensor, e.g., a photoreflector (photocoupler) 280 is fixed. The photoreflector 280 includes a light emitting element 280*a* and a light receiving element 280*b* for receiving infra-red ray from the light emitting element 280*a*, and detects a beat applied to the percussion surface part 250 when the rate of change in amount of light received by the light receiving element becomes large. On the other hand, a reflective member 290, which is high in light reflectance and 0.5 to 2 mm in thickness, is formed into doughnut shape in plan on a portion of the lower surface of the percussion surface part 250 which is opposed to the photocoupler 280. In the present embodiment, the reflective member 290 is formed integrally with the mesh material that forms the percussion surface part 250. For instance, the reflective member 290 is formed by affixing a resilient resin to the mesh material having been stretched to form the percussion surface part 250.

The protectors 200*f* are formed to have their upper faces located above the upper face of the photoreflector 280, in order to prevent the sensor part, e.g., the photoreflector (contactless sensor) 280 from being damaged when a beat is applied to the percussion surface part 250 or the percussion surface part is depressed strongly. The contactless sensor 280 may be a magnetic sensor. Alternatively, a sensor for force displacement detection may be provided at a location where the engaging recess 200*d* of the engaging piece 200*b* of the transparent frame 200 crosses the engaging loop portion 261 of the extension member 260.

A plurality of (e.g., eight) rests 200*i* are formed on the annular floor part 200*e* of the transparent frame 200 at equal intervals circumferentially of the frame 200. Each of the rests 200*i* is formed close to the sensor support 200*g* and the photoreflector 280 mounted thereon as viewed in the circumference direction. The annular floor part 200*e* includes supporting portions 320 that are aligned with respective ones of the rests 200*i* and whose lower surfaces are flush with the lower surface of the transparent frame 200. T-shaped bifurcate light transmitters 310 are supported on respective ones of the supporting portions 320, and each of the transmitters 310 has a light entrance portion 310*a* in which a high intensity LED 300 is disposed.

Thus, the photoreflectors 280 and the LEDs 300 (both e.g., eight in number) are alternately arranged on the annular floor part 200*e* in the circumferential direction. As shown in FIG. 16C, a distance D1 between each of the photoreflectors 280 and the percussion surface central part 250*a* is the same as a distance D2 between each of the LEDs 300 and the percussion surface central part 250*a*, as viewed in plan.

Each LED 300 emits light when a beat is applied to the percussion surface part 250. In particular, the LED 300 emits strong light when a beat is applied to a portion of the percussion surface part 250 close to the photoreflector 280 adjacent to the LED 300. In this manner, the position of percussion detection by one or more of the contactless sensors 280 may be related to the position of light emission by one or more of the high intensity LEDs such that light is emitted from the LED located closest to the sensor 280 by which the percussion detection has been made. Alternatively, like the LEDs 203 (see FIG. 14), the high intensity LEDs 300 may be configured to constantly emit light and change the intensity of visible light according to the distance form the percussion surface part 250. In this case, if the high intensity LEDs 300 and the LEDs 203 are both increased in number, when the percussion surface part 250 is beaten, light emission appears on and is viewed through two circles, the first one extending along the high intensity LEDs 300 and the second one extending along the LEDs 203 and concentric with the first circle.

Referring to FIG. 16C, light emitted from the high intensity LED 300 can be viewed through the T-shaped light transmitter 310 both from above and from beneath the percussion surface part 250. Specifically, the T-shaped light transmitter 310 is comprised of the aforementioned light entrance portion 310*a* and two arm portions 310*b* and 310*c*. The light entrance portion 310*a* is disposed between the arm portions 310*b* and 310*c*. Respective one ends of the arm portions 310*b* and 310*c* function as light exit portions. The T-shaped light transmitter 310 is disposed such that the arm portions 31*b*, 310*c* extend vertically inside the rest 200, with the lower end of the lower arm portion 310*c* exposed downward from the supporting portion 320 and with the upper end of the upper arm portion 310*b* exposed upward from the upper face of the rest 200*i*. Light from the high intensity LED 300 enters the light entrance portion 310*a* of the T-shaped light transmitter 310 and is emitted from the light exit portions, i.e., both the upper end of the upper arm portion 310*b* and the lower end of the lower arm portion 310*c*. Thus, light emission upon the percussion surface part 250 being beaten can be viewed both from above (player) and from beneath (audience) the percussion surface part 250.

As explained above, in the percussion surface part 250 of the present embodiment, the reflective part constituted by the reflective member 290 formed on the percussion surface part 250 and the sensor part constituted by the photoreflector 280 are out of contact with each other. With the contactless arrangement, the percussion surface part 250 is large in coefficient of rebound observed when a beat is applied thereto.

As compared to a plate-like cymbal, a pad-type cymbal, and an acoustic cymbal, therefore, the percussion surface part (cymbal) 250 of the present embodiment is high in coefficient of rebound measured at the intermediate portion between its center 250*a* and its periphery 250*b*. In particular, the resilience of the percussion surface part 250 is especially high at locations between the peripheral portion 250*b* and the intermediate portion 250*c* where there is no equivalent of node.

For this reason, when a player beats an intermediate portion of the percussion surface part 250 with the stick, the stick receives a repulsive force from the percussion surface part 250 and is lifted up. Subsequently, the stick falls onto the percussion surface part 250, whereby a beat is applied to the percussion surface again and a second trigger is provided. In a case where a strong beat is applied to the percussion surface part 250 and/or the intermediate portion of the percussion surface part 250 is large in coefficient of rebound, just after the second trigger is provided, the stick again receives a repulsive force from the percussion surface part 250, is lifted up, and falls onto the percussion surface part 250, whereby a third trigger is provided.

In this manner, the second and/or third trigger can be provided by applying a beat to the intermediate portion of the percussion surface part 250 once. Hence, a one-hand flam play can be made. This is especially advantageous for a beginner player and a player handicapped on one hand. It should be noted that some player does not prefer to play a flam utilizing a repulsive force from the intermediate portion of the percussion surface part. In such a case, the player may beat the periphery of the percussion surface part 250 from which a large repulsive force is not generated. At or near the periphery 250*b* of the percussion surface part 250 where a holding member 220 is disposed, the resiliency (coefficient of rebound) of the percussion surface part 250 when receiving a beat is not high, and the resultant percussion feeling is close to that provided by a plate-like cymbal, a pad-type cymbal, and an acoustic cymbal.

It is not preferable that the percussion surface part 250 is kept vibrated for an excessively extended duration when a beat is applied thereto. To avoid such excessive vibration duration, the intermediate portion of the percussion surface part 250 should have a distribution of mass which is not larger than but is equal to that of the remaining part of the percussion surface part.

The sensing of a beat applied to the percussion surface part 250 can be made using a pressure sensor 212 which is installed on the hemispherical holding part 211 of the central support 210. However, the pressure sensor 212 is poor in sensitivity for sensing the second and third triggers. To ensure the sensing of the second and third triggers, the percussion detecting apparatus of the present embodiment uses a contactless sensor such as the photoreflector 280.

What is claimed is:

1. A percussion detecting apparatus comprising:

a percussion surface part formed of an air-permeable material and having a light transmitting property, said percussion surface part including a percussion surface;

a support part that supports said percussion surface part;

a detecting device that detects a beat applied to said percussion surface of said percussion surface part and outputs a beat signal indicative of the sensed beat; and a percussion pattern indicating device that performs visual indication corresponding to a percussion pattern of the beat applied to said percussion surface, at least through said percussion surface, based on the beat signal output from said detecting device, wherein said percussion pattern indicating device includes a light radiating part that is resilient and radiates light, said light radiating part is disposed on an opposite side from said percussion surface of said percussion surface part such that said light radiating part is visible through said percussion surface part from a side toward said percussion surface, and when said percussion surface of said percussion surface part is beaten, said light radiating part is pressed by said percussion surface part and is resiliently deformed, thereby applying a reaction force to said percussion surface part and changing a pattern of light radiation by said light radiating part, whereby visual indication corresponding to the percussion pattern is performed.

2. A percussion detecting apparatus as claimed in claim 1, wherein the pattern of light radiation by said light radiating part changes according to a beat position on said percussion surface.

3. A percussion detecting apparatus as claimed in claim 1, wherein said light radiating part is formed into an annular shape, as viewed in plan view, with a central point of said percussion surface as a center.

4. A percussion detecting apparatus as claimed in claim 3, wherein said light radiating part has a plurality of light transmitting parts spaced from each other, and a plurality of fixedly disposed light emitting parts associated with the light transmitting parts, respectively, and when said percussion surface of said percussion surface part is beaten, said light radiating part is pressed by said percussion surface part and is resiliently deformed, thereby changing a distance between one of said light transmitting parts close to a beat position and an associated one of said light emitting parts, whereby the pattern of light radiation by said light radiating part is changed.

5. A percussion detecting apparatus as claimed in claim 3, wherein said light radiating part includes a hollow extending in a circumferential direction and a light emitting part contained in the hollow, at least an upper part of said light radiating part is formed of a material that transmits and scatters light, and when said percussion surface of said percussion surface part is beaten, said light radiating part is pressed by said percussion surface part and is resiliently deformed, thereby causing a larger amount of light to be emitted out from a resiliently deformed portion of said light radiating part than from the other portion of said light radiating part, whereby the pattern of light radiation by said light radiating part is changed.

6. A percussion detecting apparatus as claimed in claim 1, comprising a signal output device that outputs an output signal that changes according to resilient deformation of said light radiating part, as the beat signal.

7. The percussion detecting apparatus of claim 1, wherein said percussion pattern indicating device is disposed at a predetermined location in the inner part visible from below said percussion detecting apparatus, on an opposite side from said percussion surface of said percussion surface part, wherein the visual indication by said percussion pattern indicating device can be viewed from both sides of said percussion surface, and wherein said detecting device is provided in an inner part of said support part.

8. A percussion detecting apparatus of claim 1, wherein said light radiating part being disposed at a location near or in contact with said percussion surface part when said percussion surface is not beaten, wherein a pattern of light radiation from said light radiation part changes in accordance with displacement of said percussion surface of said percussion surface part in a beat direction, the displacement being caused when said percussion surface is beaten, whereby visual indication corresponding to the percussion pattern is performed, wherein the visual indication by said percussion pattern indicating device can be viewed from both sides of said percussion surface, wherein said detecting device and said percussion pattern indicating device are provided in an inner part of said support part, and wherein said percussion pattern indicating device is disposed at a predetermined location in the inner part visible from below said percussion detecting apparatus.

9. A percussion detecting apparatus of claim 1, wherein said support part includes a holding part that is disposed to face a surface of said percussion surface part opposite from said percussion surface and is formed of a light-permeable material, wherein the visual indication by said percussion pattern indicating device can be viewed from both sides of said percussion surface, wherein said detecting device and said percussion pattern indicating device are provided in an inner part of said support part, and wherein said percussion pattern indicating device is disposed at a predetermined location in the inner part visible from below said percussion detecting apparatus.

10. A percussion detecting apparatus of claim 1, further comprising:

a plurality of detecting devices that detect a beat applied to said percussion surface of said percussion surface part and output beat signals indicative of the sensed beat, respectively;

a musical tone generating device that generates a musical tone based on a beat signal output from at least one of said detecting devices; and a musical tone parameter control device that controls parameters for a musical tone to be generated by said musical tone generating device, based on at least one of a differential between a plurality of beat signals generated by corresponding ones of said detecting devices and a sum of the beat signals, wherein the visual indication by said percussion pattern indicating device can be viewed from both sides of said percussion surface, wherein said detecting device and said percussion pattern indicating device are provided in an inner part of said support part, and wherein said percussion pattern indicating device is disposed at a predetermined location in the inner part visible from below said percussion detecting apparatus.

11. A percussion detecting apparatus of claim 1, further comprising:

an electromotive force generating device that generates an electromotive force corresponding to the beat applied to said percussion surface of said percussion surface part;

a plurality of light emitting devices caused to emit light by the electromotive force generated by said electromotive force generating device, and is operable when a beat is applied to said percussion surface of said percussion surface part, to perform visual indication corresponding to a percussion pattern of the beat; and a musical tone generating device that generates a musical tone based on the electromotive force generated by said electromotive force generating device, wherein the visual indication by said percussion pattern indicating device can be viewed from both sides of said percussion surface, wherein said percussion pattern indicating device is provided in an inner part of said support part, and wherein said percussion pattern indicating device is disposed at a predetermined location in the inner part visible from below said percussion detecting apparatus.

12. A percussion detecting apparatus of claim 1, further comprising:

a plurality of electromotive force generating devices that generate respective electromotive forces corresponding to a beat applied to said percussion surface of said percussion surface part;

a musical tone generating device that generates a musical tone based on the electromotive forces generated by said electromotive force generating devices; and a musical tone parameter control device that controls parameters for the musical tone generated by said musical tone generating device, based on at least one of a differential between electromotive forces generated by corresponding ones of said electromotive force generating devices and a sum of the electromotive forces, wherein the visual indication by said percussion pattern indicating device can be viewed from both sides of said percussion surface, wherein said percussion pattern indicating device is provided in an inner part of said support part, and wherein said percussion pattern indicating device is disposed at a predetermined location in the inner part visible from below said percussion detecting apparatus.

13. A percussion detecting apparatus of claim 1, further comprising:

an electromotive force generating device that generates an electromotive force corresponding to the beat applied to said percussion surface of said percussion surface part;

a musical tone generating device that generates a musical tone based on the beat signal output from said detecting device; and a light emitting device that emits light based on the electromotive force generated by said electromotive force generating device, and is operable when a beat is applied to said percussion surface of said percussion surface part, to perform visual indication corresponding to a percussion pattern of the beat.

* * * * *